US008653752B2

(12) United States Patent
Sakuragi et al.

(10) Patent No.: US 8,653,752 B2
(45) Date of Patent: Feb. 18, 2014

(54) LIGHT-EMITTING DIODE DRIVING APPARATUS FOR SUPPRESSING HARMONIC COMPONENTS

(75) Inventors: Harumi Sakuragi, Tokushima (JP); Wataru Ogura, Okaya (JP); Teruo Watanabe, Okaya (JP); Minoru Kitahara, Okaya (JP)

(73) Assignee: Nichia Corporation, Anan-shi (JP)

( * ) Notice: Subject to any disclaimer, the term of this patent is extended or adjusted under 35 U.S.C. 154(b) by 113 days.

(21) Appl. No.: 13/447,306

(22) Filed: Apr. 16, 2012

(65) Prior Publication Data

US 2013/0099683 A1 Apr. 25, 2013

(30) Foreign Application Priority Data

Apr. 14, 2011 (JP) ..... 2011-090516

(51) Int. Cl.
*H05B 37/02* (2006.01)

(52) U.S. Cl.
USPC ..... 315/299; 315/185 R; 315/210; 315/308

(58) Field of Classification Search
None
See application file for complete search history.

(56) References Cited

U.S. PATENT DOCUMENTS

| | | | | |
|---|---|---|---|---|
| 8,174,212 | B2 * | 5/2012 | Tziony et al. | 315/309 |
| 2008/0094000 | A1 * | 4/2008 | Yamamoto et al. | 315/250 |
| 2012/0229030 | A1 * | 9/2012 | Moskowitz et al. | 315/122 |
| 2012/0299489 | A1 * | 11/2012 | Sakuragi et al. | 315/187 |
| 2013/0200802 | A1 * | 8/2013 | Sakuragi et al. | 315/122 |

FOREIGN PATENT DOCUMENTS

| | | |
|---|---|---|
| JP | 2006-147933 | 6/2006 |
| JP | 2011-40701 | 2/2011 |

* cited by examiner

*Primary Examiner* — Jany Richardson
(74) *Attorney, Agent, or Firm* — Ditthavong Mori & Steiner, P.C.

(57) ABSTRACT

An LED driving apparatus for suppressing harmonic components is provided. First and fourth portions 21 and 24 are in parallel to the first and second LEDs 11 and 12, respectively. The first portion 21 controls the current amount in said first LED 11. The fourth portion 24 controls the current amount in said first and second LEDs 11 and 12. The first and fourth controllers 31 and 34 control the first and fourth portions 21, respectively. A current detector 4 detects a signal based on the amount of a current flowing from the first and second LEDs 11 and 12. A signal providing portion 6 provides a voltage based on a rectified voltage provided from a rectifying circuit 2. The first and fourth controllers 31 and 34 compare the current detection signal with the signal voltage, and control the first and fourth portions 21 and 24 based on the comparison.

10 Claims, 20 Drawing Sheets

LIGHT-EMITTING DIODE DRIVING APPARATUS FOR SUPPRESSING HARMONIC COMPONENTS

BACKGROUND OF THE INVENTION

1. Field of the Invention

The present invention relates to a driving circuit which drives light-emitting diodes, and in particular to a light-emitting diode driving apparatus which drives light-emitting diodes by using AC power supply.

2. Description of the Related Art

In recent years, significant attention is given to light-emitting diodes (hereinafter, occasionally referred to as "LEDs") as lighting sources. The reason is that LEDs can be driven at low power consumption as compared with filament lamps or fluorescent lamps. LEDs are small, and have shock resistance. In addition, LEDs are less prone to blow out. Thus, LEDs have these advantages.

In the case of lighting sources, it is desirable that commercial AC power for home use is used as power supply for lighting sources. LEDs are devices driven by DC power. LEDs emit light only when applied with a current in the forward direction. Also, in the case of LEDs that are currently typically used for lighting use, the LEDs operate on DC power at a forward directional voltage Vf of about 3.5 V. LEDs do not emit light if a voltage applied to the LEDs does not reach Vf. Conversely, a voltage applied to the LEDs exceeds Vf, an excessive amount of current will flow through the LEDs. Accordingly, it can be said that DC power is suitable for driving LEDs.

To satisfy the contradictory conditions, various types of LED driving circuits have been proposed that use AC power. For example, a method has been proposed that switches LEDs so that a Vf total value is changed in accordance with a varying voltage value (see Japanese Patent Laid-Open Publication No. JP 2006-147,933 A). In this method, a number of LEDs connected to each other in series are divided into blocks 161, 162, 163, 164, 165 and 166 as shown in a circuit diagram of FIG. 16. The LED blocks 161 to 166 are selectively connected to the power supply in accordance with the voltage value of input voltage of rectified waveform by a switch control portion 167 consisting of a microcomputer so that a Vf total value is changed in a stepped manner. As a result, as shown by a voltage waveform in a timing chart of FIG. 17, since the LEDs can be driven by a plurality of rectangular waves corresponding to the rectified waveform, the LED usage ratio efficiency can be improved as compared with the ON-duty in the case of only single rectangular wave.

On the other hand, the applicant has been developed an AC multi-stage circuit which includes a plurality of serially-connected LED blocks operated by an AC current after full-wave rectification, each of the plurality of LED blocks having a plurality of serially-connected LEDs (Japanese Patent Laid-Open Publication No. JP 2011-40,701 A).

As shown in FIG. 18, this AC multi-stage circuit subjects a current from an AC power supply AP to full-wave rectification in a bridge circuit 2 so that the LED blocks of multi stages are supplied with the current after the full-wave rectification. As the LED blocks of multi stages, first, second and third LED blocks 11, 12 and 13 are serially connected to each other. A first LED current control transistor 21A is turned ON/OFF to connect/disconnect a first bypass BP1 which bypasses the second LED block 12 based on the current amount in the first LED block 11. A second LED current control transistor 22A is turned ON/OFF to connect/disconnect a second bypass BP2 which bypasses the third LED block 13 based on the current amount in the first and second LED blocks 11 and 12.

This AC multi-stage circuit can keep power supply efficiency high, and additionally improve the LED usage ratio efficiency and the power factor.

FIG. 19 shows the current waveform of this AC multi-stage circuit. As shown in this figure, the current waveform has a stepped shape in synchronization with the power supply cycle. This stepped current waveform has a shape close to a waveform of a sine wave current. However, this current varies in a stepped manner, which in turn may cause harmonic interference. In the case where a filament lamp is used as load instead of LEDs, its current waveform will be a sine wave. For this reason, in this case, harmonic interference will not occur. Lighting apparatuses are classified into the class C in the IEC61000-3-2 standards. In the standards, the harmonic limit is specified. In particular, the limit for apparatuses of not smaller than 25 W is higher as compared with apparatuses of not higher than 25 W. From this viewpoint, it may be difficult for the AC multi-stage circuit shown in FIG. 18 to meet the limit.

FIG. 20 is a graph showing exemplary measurement data of harmonic current in a light-emitting diode driving method shown in Patent Laid-Open Publication No. JP 2006-147,933 A. As shown in this graph, the measured values in some harmonic orders, in particular 11th, 13th and 15th orders, exceed the limits, and do not meet the standards.

The present invention is devised to solve the above problems. It is a main object of the present invention to provide a light-emitting diode driving apparatus capable of suppressing harmonic components.

SUMMARY OF THE INVENTION

To achieve the above object, a light-emitting diode driving apparatus according a first aspect of the present invention includes a rectifying circuit 2, a first LED section 11, a second LED section 12, a first portion 21, a fourth portion 24, a first current control portion 31, a fourth current control portion 34, a current detection portion 4, and a harmonic suppression signal providing portion 6. The rectifying circuit 2 can be connected to AC power supply AP and rectifies an AC voltage of the AC power supply AP to provide a rectified voltage. The first LED section 11 includes at least one LED device connected to the rectifying circuit 2. The second LED section 12 includes at least one LED device serially connected to the first LED section 11. The first portion 21 is connected in parallel to the second LED section 12, and controls the flowing current amount in the first LED section 11. The fourth portion 24 is serially connected to the first portion 21, and controls the flowing current amount in the first and second LED sections 11 and 12. The first current control portion 31 controls the first portion 21. The fourth current control portion 34 controls the fourth portion 24. The current detection portion 4 detects a current detection signal based on the amount of a current flowing in an output line OL serially connected from the first LED section 11 to the second LED section 12. The harmonic suppression signal providing portion 6 provides a harmonic suppression signal voltage based on the rectified voltage provided from the rectifying circuit 2. The first and fourth current control portions 31 and 34 compare the current detection signal detected by the current detection portion 4 with the harmonic suppression signal voltage provided by the harmonic suppression signal providing portion 6, and control the first and fourth portions 21 and 24 based on the comparison result whereby suppressing harmonic components.

In a light-emitting diode driving apparatus according a second aspect of the present invention, a third LED section 13, a second portion 22, and a second current control portion 32 can be further provided. The third LED section 13 includes at least one LED device serially connected to the second LED section 12. The second portion 22 is connected in parallel to the third LED section 13, and controls the flowing current amount in the first and second LED sections 11 and 12. The second current control portion 32 controls the second portion 22. The second current control portion 32 compares the current detection signal, which is detected by the current detection portion 4, with the harmonic suppression signal voltage, which is provided by the harmonic suppression signal providing portion 6. The second current control portion 32 controls the second portion 22 based on the comparison result whereby suppressing harmonic components. The fourth portion 24 controls the flowing current amount in the first, second and third LED sections 11, 12 and 13. According to this construction, the output waveform can be adjusted/controlled based on the comparison result between the input-side harmonic component and the obtained LED driving current. Therefore, it is possible to effectively suppress harmonic components.

In a light-emitting diode driving apparatus according a third aspect of the present invention, a fourth LED section 14, a third portion 23, and a third current control portion 33 can be further provided. The fourth LED section 14 includes at least one LED device connected in parallel to the third LED section 13. The third portion 23 is connected serially to the fourth LED section 14, and controls the flowing current amount in the first, second and third LED sections 11, 12 and 13. The third current control portion 33 controls the third portion 23. The fourth portion 24 controls the flowing current amount in the first, second, third and fourth LED sections 11, 12, 13 and 14.

In a light-emitting diode driving apparatus according to a fourth aspect of the present invention, an LED driving portion 3 can be further provided that is connected in parallel to the fourth portion 24.

In a light-emitting diode driving apparatus according a fifth aspect of the present invention, a current detection signal providing portion 5 can be further provided that distributes the current detection signal detected by the current detection portion 4, and provides the distributed signals to the first, second, third and fourth current control portions 31, 32, 33 and 34. According to this construction, the light-emitting diode driving apparatus can operate on a current with a waveform which has suppressed harmonic components by the action of the current detection signal providing portion and the harmonic suppression signal providing portion.

In a light-emitting diode driving apparatus according a sixth aspect of the present invention, a voltage variation suppression signal providing portion 8 can be further provided that mixes the outputs of the first, second, third and fourth LED sections 11, 12, 13 and 14 to produce a voltage variation suppression signal, and provide the voltage variation suppression signal to the current detection signal providing portion 5. According to this construction, since the current detection portion can be provided with the voltage variation suppression signal in addition to the current detection signal, a current can be more accurately controlled so as to suppress harmonic components.

In a light-emitting diode driving apparatus according a seventh aspect of the present invention, after mixing the outputs of the first, second, third and fourth LED sections 11, 12, 13 and 14 to produce a voltage variation suppression signal, and adding the voltage variation suppression signal to the current detection signal as the current value, which is detected by the current detection portion 4, the current detection signal providing portion 5 can provide the first, second, third and fourth current control portions 31, 32, 33 and 34 with the signal obtained by adding the voltage variation suppression signal to the current detection signal.

In a light-emitting diode driving apparatus according an eighth aspect of the present invention, after mixing the outputs of the first, second, third and fourth LED sections 11, 12, 13 and 14 to produce a voltage variation suppression signal, and integrating the voltage variation suppression signal, the current detection signal providing portion 5 provides the integrated signal to the first, second, third and fourth current control portions 31, 32, 33 and 34.

In a light-emitting diode driving apparatus according to a ninth aspect of the present invention, a dimmer 61' can be further provided that is connected to the harmonic suppression signal providing portion 6, and adjusts the light intensity of the LED sections. According to this construction, it is possible to adjust the light intensity of the LED sections by means of the dimmer in addition to harmonic suppression function.

In a light-emitting diode driving apparatus according a tenth aspect of the present invention, the harmonic suppression signal providing portion 6 can include a plurality of current detection voltage dividing resistors which are serially connected to each other. According to this construction, a current can be controlled in accordance with a sine wave of pulsating current, which is rectified by the rectifying circuit, so that the LED driving current can be brought close to a waveform approximating the sine wave.

The above and further objects of the present invention as well as the features thereof will become more apparent from the following detailed description to be made in conjunction with the accompanying drawings.

DETAILED DESCRIPTION OF THE EMBODIMENT(S)

Figure 1A:
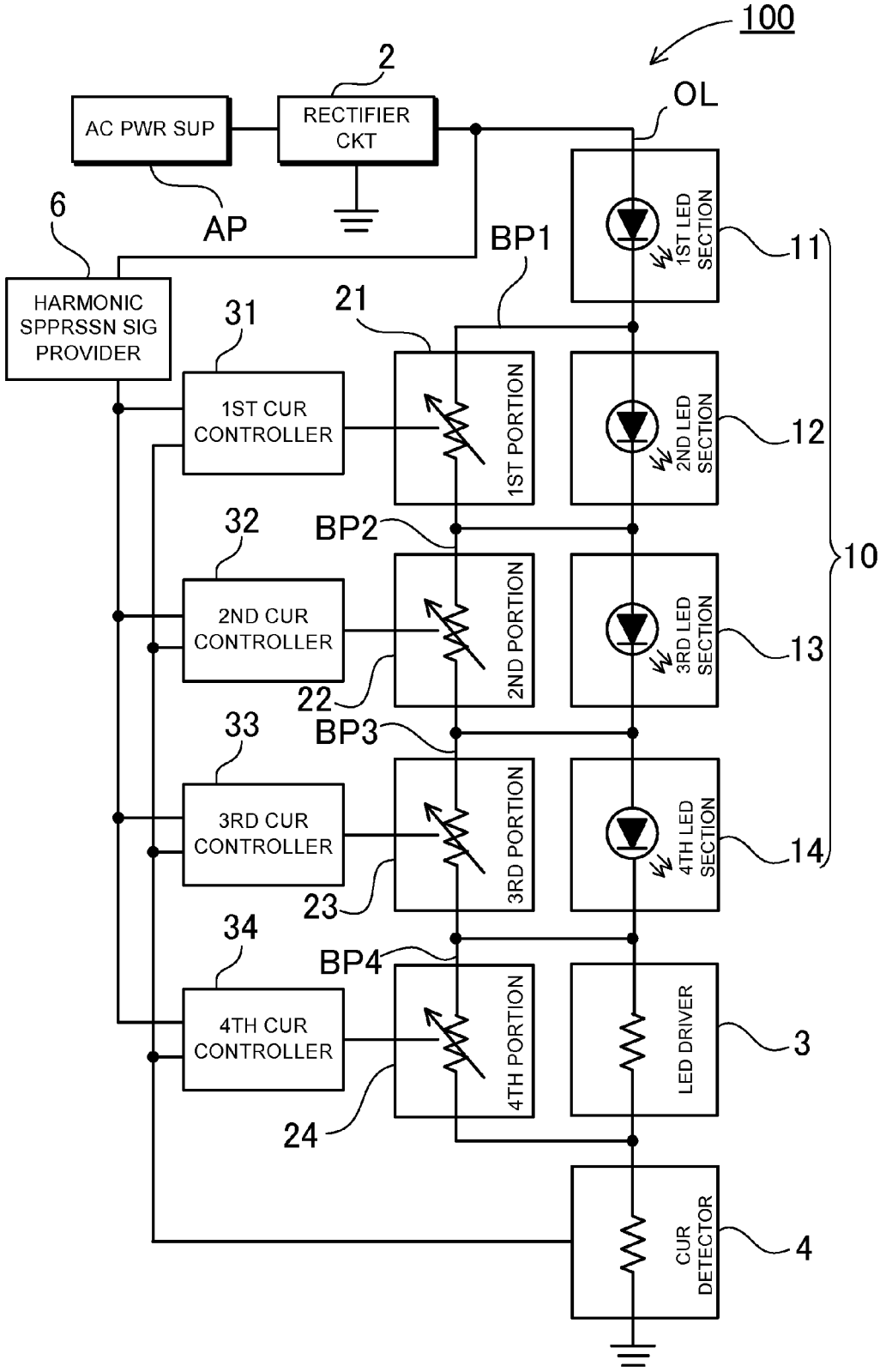
FIG. 1A is a block diagram showing a light-emitting diode driving apparatus according to a first embodiment.

The following description will describe embodiments according to the present invention with reference to the drawings. It should be appreciated, however, that the embodiments described below are illustrations of a light-emitting diode driving apparatus used therein to give a concrete form to technical ideas of the invention, and a light-emitting diode driving apparatus of the invention is not specifically limited to description below. Furthermore, it should be appreciated that the members shown in claims attached hereto are not specifically limited to members in the embodiments. Unless otherwise specified, any dimensions, materials, shapes and relative arrangements of the parts described in the embodiments are given as an example and not as a limitation. Additionally, the sizes and the positional relationships of the members in each of drawings are occasionally shown larger exaggeratingly for ease of explanation. Members same as or similar to those of this invention are attached with the same designation and the same reference numerals, and their description is omitted. In addition, a plurality of structural elements of the present invention may be configured as a single part that serves the purpose of a plurality of elements, on the other hand, a single structural element may be configured as a plurality of parts that serve the purpose of a single element. Also, the description of some of examples or embodiments may be applied to other examples, embodiments or the like.

In order that a light-emitting diode driving apparatus may meet the harmonic current standards, it is desired to flow a current having a current waveform of sine wave similar to filament lamps. According to the light-emitting diode driving apparatuses of embodiments of the present invention, a sine wave is superimposed on the threshold voltage of an LED current control portion so that the waveform of LED driving current in brought to a waveform approximating a sine wave. Thus, the light-emitting diode driving apparatus can be provided which is inexpensive and compact, and meets the harmonic current standards for apparatuses of not smaller than 25 W.

First Embodiment

FIG. 1A is a block diagram showing a light-emitting diode driving apparatus 100 according to a first embodiment. The light-emitting diode driving apparatus 100 includes a rectifying circuit 2, an LED portion 10, first to fourth portions 21 to 24, a current control portion, and a current detection portion 4. In the light-emitting diode driving apparatus 100, the rectifying circuit 2, and the LED portion 10 are serially connected to each other through an output line OL. The rectifying circuit 2 is connected to AC power supply AP, and obtains a pulsating voltage by rectifying an AC voltage. The LED portion 10 includes a plurality of LED sections. In this embodiment, four LED sections are used as first, second, third and fourth LED sections 11, 12, 13 and 14, which are serially connected to each other. Thus, the first to fourth LED sections compose the LED portion 10. In addition, the LED portion 10, a LED driving portion 3, and a current detection portion 4 are serially connected to each other through the output line OL.

A first portion 21, a second portion 22, and a third portion 23 are connected to the second LED section 12, the third LED section 13, and the fourth LED section 14. Each of the first to third portions is connected to the both ends of corresponding one of the second to fourth LED sections to restrict the flowing current amount in the LED section(s). Each of the first, second and third portions 21, 22 and 23 is thus connected in parallel to corresponding one of the LED sections. Accordingly, each of the first to third portions serves as a bypass path that adjusts the flowing current amount in the LED section(s). In other words, each of the first, second and third portions 21, 22 and 23 can adjust the amount of a bypassed current, which in turn can control the flowing current amount in the LED section(s). In the case of FIG. 1A, the first portion 21 is connected in parallel to the second LED section 12, and serves as a first bypass path BP1. Also, the second portion 22 is connected in parallel to the third LED section 13, and serves as a second bypass path BP2. Also, the third portion 23 is connected in parallel to the fourth LED section 14, and serves as a third bypass path BP3. An output current can flow also in the bypass paths which bypass the LED section(s) and the like, which is/are connected to the output line. From this viewpoint, the output line can include the bypass paths in this specification.

(Current Control Portion)

Current control portions for controlling a constant current circuit are provided to drive LED sections at a constant current. In this exemplary circuit, the first, second, third and fourth portions 21, 22, 23 and 24, and the first, second, third and fourth current control portions 31, 32, 33 and 34 compose a sort of constant current circuit.

Each of the current control portions is connected to corresponding one of the first, second, third and fourth portions 21, 22, 23 and 24, and controls ON/OFF operation and flowing current amount continuously-varying operation of corresponding one of the first, second, third and fourth portions 21, 22, 23 and 24. Specifically, the first current control portion 31 controls operation of the first portion 21. The second current control portion 32 controls operation of the second portion 22. The third current control portion 33 controls operation of the third portion 23. The fourth current control portion 34 controls operation of the fourth portion 24. The first, second, third and fourth control portions 31, 32, 33 and 34 are connected to the current detection portion 4 so that the LED current amount is monitored. The first, second, third and fourth current control portions 31, 32, 33 and 34 vary the control amount of the first, second, third and fourth portions 21, 22, 23 and 24, respectively, based on the LED current amount values.

Each LED section includes one LED device or a plurality of LED devices which are connected to each other in series and/or in parallel. Surface-mount type LEDs (SMDs) or bullet type LEDs can be suitably used for the LED devices. SMD type LED devices can have packages with various external shapes, such as a rectangular shape in plan view, depending on applications. Needless to say, a plurality of LED devices can be connected to each other in series and/or in parallel inside an LED package as the LED section.

A subtotal forward directional voltage of LED devices which are included in this LED section is defined by the sum of the forward directional voltages of LED devices which are included in this LED section. The subtotal forward directional voltage is determined by the number of the LED devices which are connected to each other in series in this LED section. For example, in the case where sixth LED devices are employed that have a forward directional voltage of 3.6 V, the subtotal forward directional voltage of the six LED devices will be 3.6×6=21.6 V.

The light-emitting diode driving apparatus 100 switches ON/(constant current control)/OFF of each LED section based on a current value detected by the current detecting portion 4. In other words, a current is controlled not based on the voltage value of rectified voltage but based on the amount of an actually-flowing current. For this reason, ON/(constant current control)/OFF of the LED sections can be accurately switched at appropriate timing irrespective of deviation of the forward directional voltages of LED devices. Therefore, reliable and stable operation can be expected. The current value can be detected by the current detection portion 4, or the like.

In the case of FIG. 1A, the first current control portion 31 controls the restriction amount on a flowing current in the first LED section 11 restricted by the first portion 21 based on the flowing current amount in the first LED section 11. Specifically, in the case where the first, second and third fourth portions 21, 22 and 23 is in ON, when the flowing current amount reaches a predetermined first threshold current value, the first portion 21 drives the first LED section 11 at a constant current. Subsequently, the input voltage will rise. When the input voltage reaches a voltage which can drive the first and second LED sections 11 and 12 together, a current starts flowing into the second LED section 12. Subsequently, when a current exceeds the first threshold current value, the first portion 21 is turned OFF. Also, the second current control portion 32 controls the flowing current limit for the first and second LED sections 11 and 12 through the second portion 22 based on the flowing current amount in the first LED and second portions 11 and 12. Specifically, when the flowing current amount reaches a predetermined second threshold current value, the second portion 22 drives the first and second LED sections 11 and 12 at a constant current. Subsequently, the input voltage will rise. When the input voltage reaches a voltage which can drive the first, second and third LED sections 11, 12 and 13 together, a current starts flowing into the third LED section 13. Subsequently, when a current exceeds the second threshold current value, the second portion 22 is turned OFF.

Also, the third current control portion 33 controls the flowing current limit for the first, second and third LED sections 11, 12 and 13 through the third portion 23 based on the flowing current amount in the first, second and third LED sections 11, 12 and 13. Specifically, when the flowing current amount reaches a predetermined third threshold current value, the third portion 23 drives the first, second and third LED sections 11, 12 and 13 at a constant current. Subsequently, the input voltage will rise. When the input voltage reaches a voltage which can drive the first, second, third and fourth LED sections 11, 12, 13 and 14 together, a current starts flowing into the fourth LED section 14. Subsequently, when a current exceeds the third threshold current value, the third portion 23 is turned OFF. Finally, the fourth portion 24 and the fourth current control portion 34 drive the first, second, third and fourth LED sections 11, 12, 13 and 14 at a constant current.

In the case where the threshold current values are specified first threshold current value<second threshold current value<third threshold current value, the first, second, third and fourth LED sections 11, 12, 13 and 14 can be turned ON/(constant current control)/OFF in this order. It should be noted that these threshold current can be adjusted freely by controlling an input signal to one of the input terminal of the current control portions 31-34. For example, if sinusoidal voltage is input into the input terminal, then current control corresponding to sine wave is achieved, which is discussed later.

The light-emitting diode driving apparatus 100 using AC power AP such as commercial power for home use includes a plurality of constant current circuits that drive serially-connected LED devices in accordance with a periodically-varying pulsating voltage that is obtained after an alternating current is subjected to full-wave rectification. Thus, the constant current circuits can be appropriately driven by the LED current detecting circuits.

The light-emitting diode driving apparatus 100 applies a first current value to the first LED section 11, a second current value larger than the first current value to the first and second LED sections 11 and 12, a third current value larger than the second current value to the first, second and third LED sections 11, 12 and 13, and a fourth current value larger than the third current value to the first, second, third and fourth LED sections 11, 12, 13 and 14. In particular, since a flowing current amount in the LED section(s) is controlled in a constant current control manner, the LED section can be turned ON/(constant current control)/OFF in accordance with the flowing current amount. Therefore, the LEDs can be efficiently driven by a pulsating voltage.

In the case of FIG. 1A, the LED driving portion 3 is connected in parallel to the fourth portion 24 so that a current, which will flow in the fourth portion 24, can be partially branched also into the LED driving portion 3. Thus, the LED driving portion 3 can reduce the load of the fourth portion 24.

(Harmonic Suppression Signal Providing Portion 6)

The first to fourth control portions 31 to 34 are connected to the harmonic suppression signal providing portion 6. The harmonic suppression signal generation portion 6 provides a harmonic suppression signal voltage based on the rectified voltage provided from the rectifying circuit 2. The harmonic suppression signal providing portion 6 reduces a pulsating voltage rectified by the rectifying circuit 2 at a certain ratio, and provides the reduced voltage as reference signal to the first to fourth current control portions 31 to 34 so that an LED current detection signal is compared with the reference signal. The current control portions drive the LED sections at suitable timing and suitable currents based on the comparison result by using the first to fourth portions 21 to 24.

(Exemplary Circuit According to First Embodiment)

Figure 2:
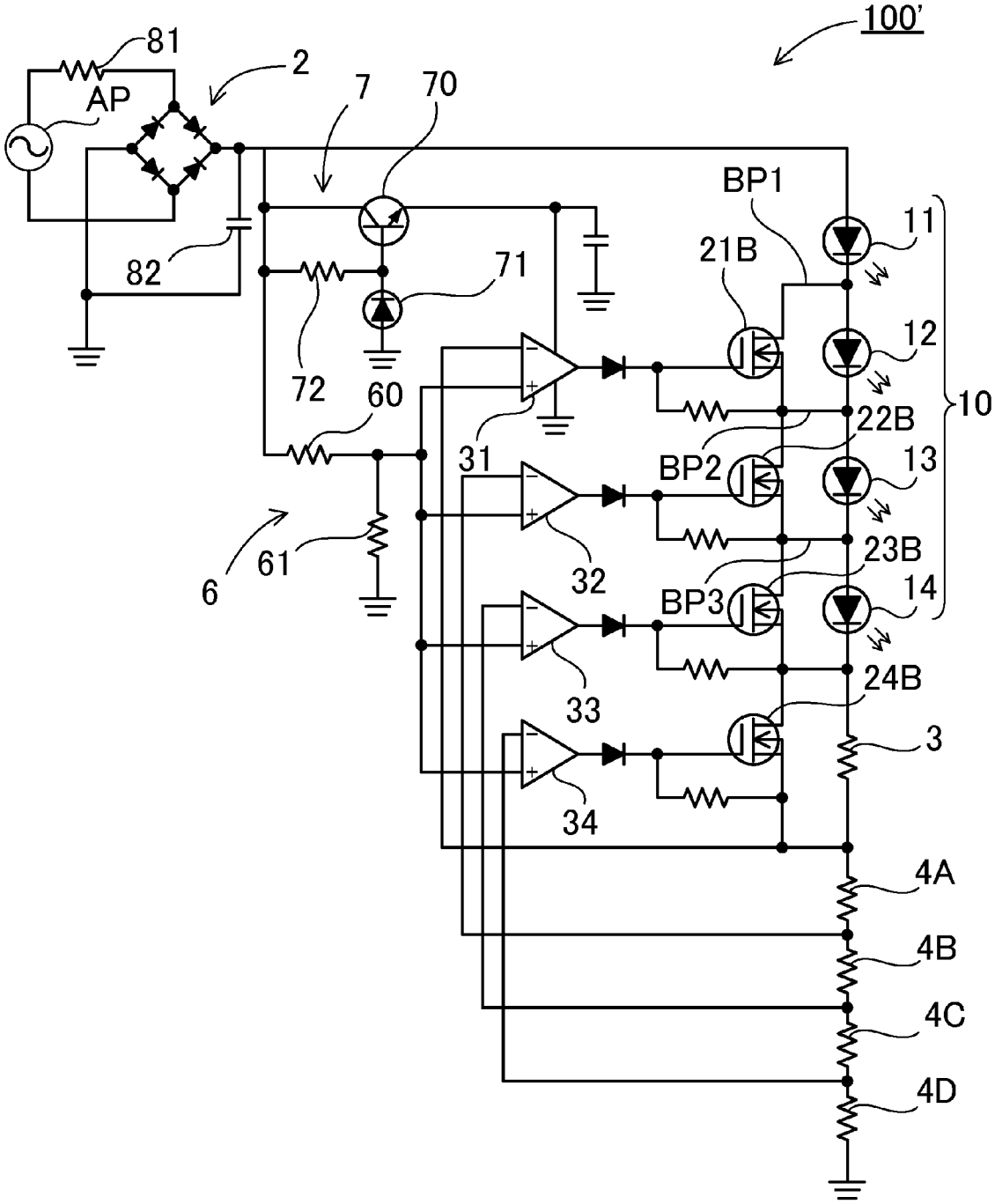
FIG. 2 is a circuit diagram showing an exemplary circuit of the light-emitting diode driving apparatus shown in FIG. 1A.

FIG. 2 shows an exemplary circuit of the light-emitting diode driving apparatus 100 shown in FIG. 1A, which includes semiconductor devices. In a light-emitting diode driving apparatus 100', a diode bridge is used as the rectifying circuit 2 connected to the AC power supply AP. A protection resistor 81 is connected between the AC power supply AP and the rectifying circuit 2. A bypass capacitor 82 is connected to an output side of the rectifying circuit 2. In addition, although not illustrated, a fuse and a surge protection circuit for preventing an over-current flow can be connected between the AC power supply AP and the rectifying circuit 2.

(AC Power Supply AP)

The 100-V or 200-V commercial power can be suitably used as the AC power supply AP. The voltage 100 or 200 V in this commercial power is an effective value. The maximum voltage of a rectified waveform subjected to full-wave rectification will be about 141 or 282 V.

(LED Portion 10)

A plurality of LEDs are divided into a plurality of LED blocks as LED sections which compose the LED portion 100. The LED blocks are connected to each other in series. Terminals are provided between the blocks, and are connected to the first, second, third and fourth portions 21, 22, 23 and 24. The LED portion 10 is composed of four groups as the first, second, third and fourth LED sections 11, 12, 13 and 14 in the case of FIG. 2.

In FIG. 2, each of the LED sections 11 to 14 is shown by a single LED symbol, which represents an LED package 1 including a plurality of LED chips. In this embodiment, each LED package 1 includes ten LED chips. The number of light-emitting diodes to be connected to each other in each LED section or the number of the LED sections to be connected to each other can be determined by the sum of forward directional voltages (i.e., the number of the LED devices connected to each other in series) and the voltage of power supply to be used. For example, in the case where the commercial power is used, a total forward directional voltage $Vf_{all}$ as the sum of Vf values of the LEDs of the LED sections is adjusted to about 141 V or not more than 141 V.

Each LED section can include an arbitrary number of LED devices (at least one LED). The LED device can be a single LED chip, or a single package including a plurality of collectively-arranged LED chips. In this embodiment, each of the illustrated LED symbols is the LED package 1 which includes ten LED chips.

The four LED sections have the same Vf value in the case of FIG. 2. However, the number of LED sections is not limited to this. The number of LED sections can be three or less, or five or more so that these LED sections have the same Vf value similarly. In the case where the number of LED sections is increased, the number of constant current circuits is increased which is applied to the LED sections in constant current control. In this case, the LED section switching transition can be smoother. Alternatively, the Vf values of LED sections may not be the same.

(First to Fourth Portions 21 to 24)

Each of the first, second, third and fourth portions 21, 22, 23 and 24 drive the LED section(s) at a constant current. The first to fourth portions 21 to 24 are composed of switching devices such as transistors. In particular, FETs are preferable. The reason is that saturation voltage between source and drain of FET is substantially zero, and will not reduce a flowing current amount in the LED section. However, needless to say, the first to fourth portions 21 to 24 are not limited to FETs but can be composed of bipolar transistors or the like.

In the case of FIG. 2, LED current control transistors are used as the first to fourth portions 21 to 24. Specifically, the second LED section 12 is connected in parallel to a first LED current control transistor 21B. Also, the third LED section 13 is connected in parallel to a second LED current control transistor 22B. Also, the fourth LED section 14 is connected in parallel to a third LED current control transistor 23B. Also, the LED driving portion 3 is connected in parallel to a fourth LED current control transistor 24B. The first to fourth LED current control transistors 21B to 24B serve as the first to fourth portions 21 to 24, respectively. Each of the LED current control transistors is switched between ON/OFF state and constant current control in accordance with the current amount in the LED section(s) previous to the corresponding one of the LED sections and the LED driving portion, which is connected in parallel to this LED current control transistor. When the LED current control transistor is turned OFF, the current will not flow in the bypass path so that the current starts flowing the corresponding LED section. In other words, each of the first to fourth portions 21 to 24 can adjust the amount of a bypassed current, which in turn can control the flowing current amount in the LED section(s) previous to the corresponding one of the LED sections and the LED driving portion. In the case of FIG. 2, the first portion 21 is connected in parallel to the second LED section 12, and serves as the first bypass path BP1. Also, the second portion 22 is connected in parallel to the third LED section 13, and serves as the second bypass path BP2. Also, the third portion 23 is connected in parallel to the fourth LED section 14, and serves as the third bypass path BP3. Also, the fourth LED current control transistor 24B is connected, and can control the flowing current amount in the first, second, third and fourth LED sections 11, 12, 13 and 14.

The first LED section 11 is connected in parallel to neither the bypass paths nor the first to fourth portions. The reason is that the flowing current amount in the first LED section 11 can be controlled by the first portion 21, which is connected in parallel to the second LED section 12. Also, the flowing current amount in the fourth LED section 14 can be controlled by the fourth LED current control transistor 24B.

In the case of FIG. 2, a resistor 3 is used as the LED driving portion 3. In this case, since the LED driving portion 3 is connected in parallel to the fourth portion of the transistor, a current can be bypassed if the amount of the current becomes large. Therefore, it is possible to reduce the load of the fourth portion. However, the LED driving portion 3 may be omitted.

In the case of FIG. 2, FETs are used as the LED current control transistors. In the case where the ON/OFF switching operation is controlled one by one by means of the first, second, third and fourth LED current control transistors 21B, 22B, 23B and 24B, the control semiconductor device such as FET, which composes each LED current control transistor, is connected between the both ends of each LED section. Accordingly, the control semiconductor device is protected from exceeding its breakdown voltage by the subtotal forward directional voltage of each LED section. For this reason, advantageously, low-breakdown voltage, small semiconductor devices can be employed.

(First, Second, Third and Fourth Current Control Portions 31, 32, 33 and 34)

The first, second, third and fourth current control portions 31, 32, 33 and 34 control the first to fourth portions 21 to 24 so that the first to fourth portions 21 to 24 drive the corresponding LED sections at a constant current at appropriate timing. Switching elements such as transistors can be used as the first to fourth current control portions. In particular, bipolar transistors can be suitably employed to detect a current amount. In this embodiment, the first, second, third and fourth current control portions 31, 32, 33 and 34 are composed of operational amplifiers. However, needless to say, the current control portion is not limited to operational amplifiers, but can be composed of comparators, bipolar transistors, MOSFETs, or the like.

In the case of FIG. 2, the current control portions control operation of the LED current control transistors. In other words, each of the operational amplifiers is switched ON/(constant current control)/OFF so that corresponding one of the LED current control transistors is switched to ON/(constant current control)/OFF.

(Current Detection Portion 4)

The current detection portion 4 includes a plurality of current detection voltage dividing resistors. In the case of FIG. 2, first, second, third and fourth LED current detection resistors 4A, 4B, 4C and 4D as four LED current detection resistors are serially connected to each other. These resistors also serve as protection resistors for protecting LEDs. The LED current detection resistors 4A, 4B, 4C and 4D detect a flowing current in the LED portion 10 composed of serially-connected LED sections based on voltage drop or the like. Thus, LED devices which compose LED sections are driven at a constant current. Current control portions for controlling a constant current circuit are provided to drive LED devices at a constant current. In this exemplary circuit, the first, second, third and fourth portions 21, 22, 23 and 24, and the first, second, third and fourth current control portions 31, 32, 33 and 34 compose a sort of constant current circuit.

The resistances of the LED current detection resistors specify the ON/OFF timing of the current control portions, in other words, determine the current amounts at which the current control portions are turned ON/OFF. In this embodiment, the resistances of the LED current detection resistors are previously set which turn the first to fourth current control portions 31 to 34 of operational amplifiers ON one by one in this order.

(Threshold Current Value)

The first current control portion 31 switches the first LED current control transistor 21 from ON to OFF at a first threshold current value. The second current control portion 32 switches the second LED current control transistor 22 from ON to OFF at a second threshold current value. In this embodiment, the first threshold current value is smaller than the second threshold current value. Also, the third current control portion 33 switches the third LED current control transistor 23 from ON to OFF at a third threshold current value. The third threshold current value is greater than the second threshold current value. Also, the fourth current control portion 34 switches the fourth LED current control transistor 24 from ON to OFF at a fourth threshold current value. The fourth threshold current value is greater than the third threshold current value. In the case where the threshold current values are specified first threshold current value<second threshold current value<third threshold current value<fourth threshold current value, as the input voltage rises which is rectified by the rectifying circuit 2, the first, second, third and fourth LED sections 11, 12, 13 and 14 can be turned to ON/constant current control from OFF in this order. On the other hand, as the input voltage decreases, the LED sections are turned OFF in the inverse order.

(Operation of Harmonic Suppression Signal Providing Portion 6)

With reference to FIG. 2, the operation of the harmonic suppression signal providing portion 6 is now described in the light-emitting diode driving apparatus 100'. In the exemplary circuit of FIG. 2, the current control portions are composed of the operational amplifiers 31 to 34. The operational amplifiers 31 to 34 are controlled by the harmonic suppression signal providing portion 6.

Specifically, the operational amplifiers 31 to 34 are driven by a constant voltage power supply 7. The constant voltage power supply 7 includes an operational amplifier power supply transistor 70, a zener diode 71, and a zener voltage setting resistor 72. The constant voltage power supply 7 supplies power to the operational amplifiers 31 to 34 only during the period which the zener voltage of the zener diode 71 is lower than the pulsating voltage after the rectifying circuit 2 rectifies the current from the AC power supply AP. This period is previously set so as to include the LED ON period. That is, the operational amplifier operates during the LED ON period, and controls the LED ON states.

The harmonic suppression signal providing portion 6 includes harmonic suppression signal providing resistors 60 and 61. The harmonic suppression signal generation resistance 60 and 61 divides the pulsating voltage, which is rectified by the rectifying circuit 2. In other words, the harmonic suppression signal providing portion 6 reduces the pulsating voltage at a certain ratio. The positive-side input terminal of each operational amplifier is provided with a harmonic suppression signal, which is a reduced sine wave provided from the side where the harmonic suppression signal providing resistors 60 and 61 are connected.

On the other hand, the negative-side input terminals of the operational amplifiers are provided with voltages which are detected by current detection resistor equipment. In the case of FIG. 2, the current detection resistor equipment is composed of the current detection resistors 4A, 4B, 4C and 4D, which are serially connected to each other as discussed above. Voltages between the current detection voltage dividing resistors 4A, 4B, 4C and 4D are specified so that the operational amplifiers serve to control a current in correspondingly predetermined periods, in other words, so that a current can be controlled in accordance with a sine wave applied to the positive-side input terminals of the operational amplifiers. Thus, positive-side input terminals of the operational amplifiers can be provided with a sine wave of pulsating current, which is rectified by the rectifying circuit 2. Since the LED driving current can be controlled in accordance with a sine wave of pulsating current, the LED driving current can have a shape approximating the sine wave.

Figure 3:
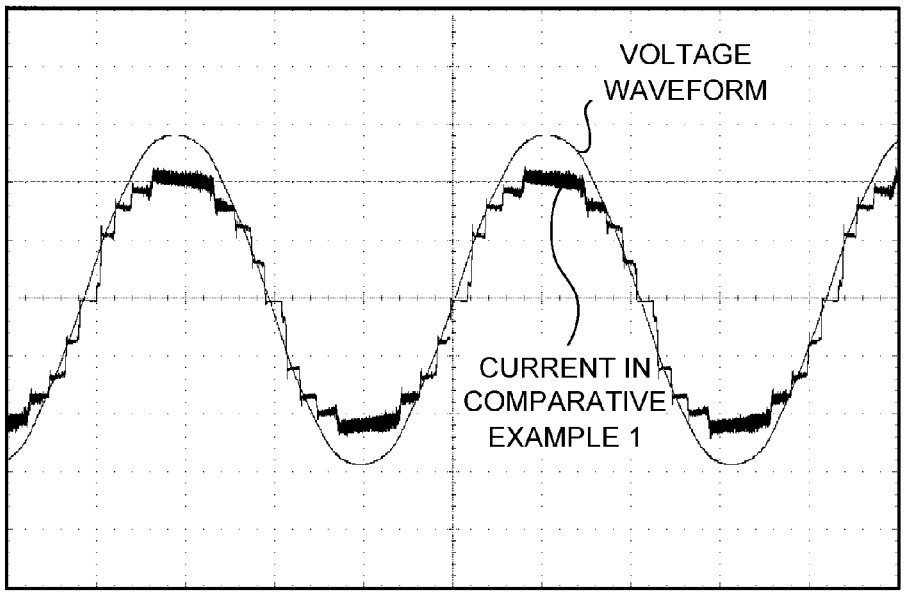
FIG. 3 is a graph showing superimposed current waveforms of a power supply voltage and a comparative example 1.
Figure 4:
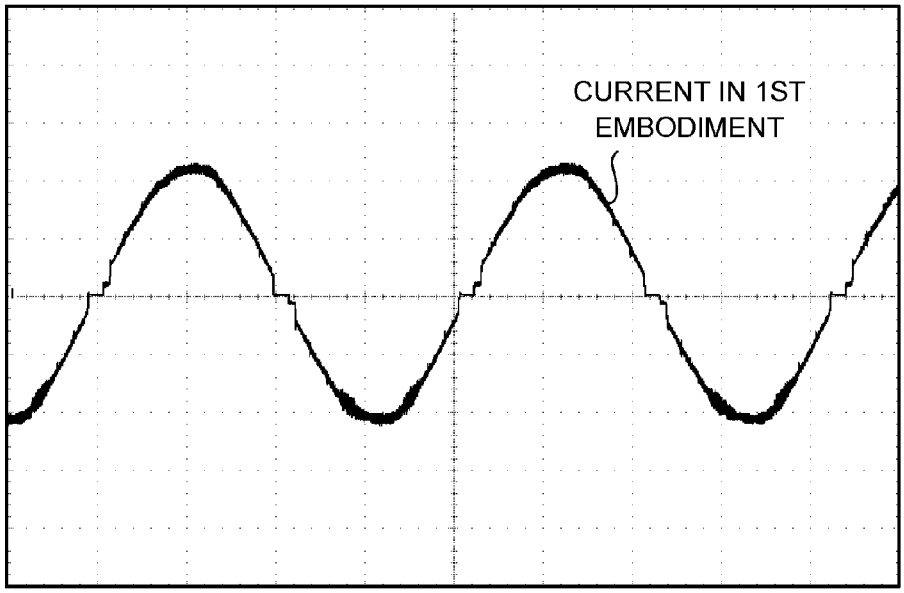
FIG. 4 is a graph showing a current waveform measured in the exemplary circuit according to the first embodiment.
Figure 18:
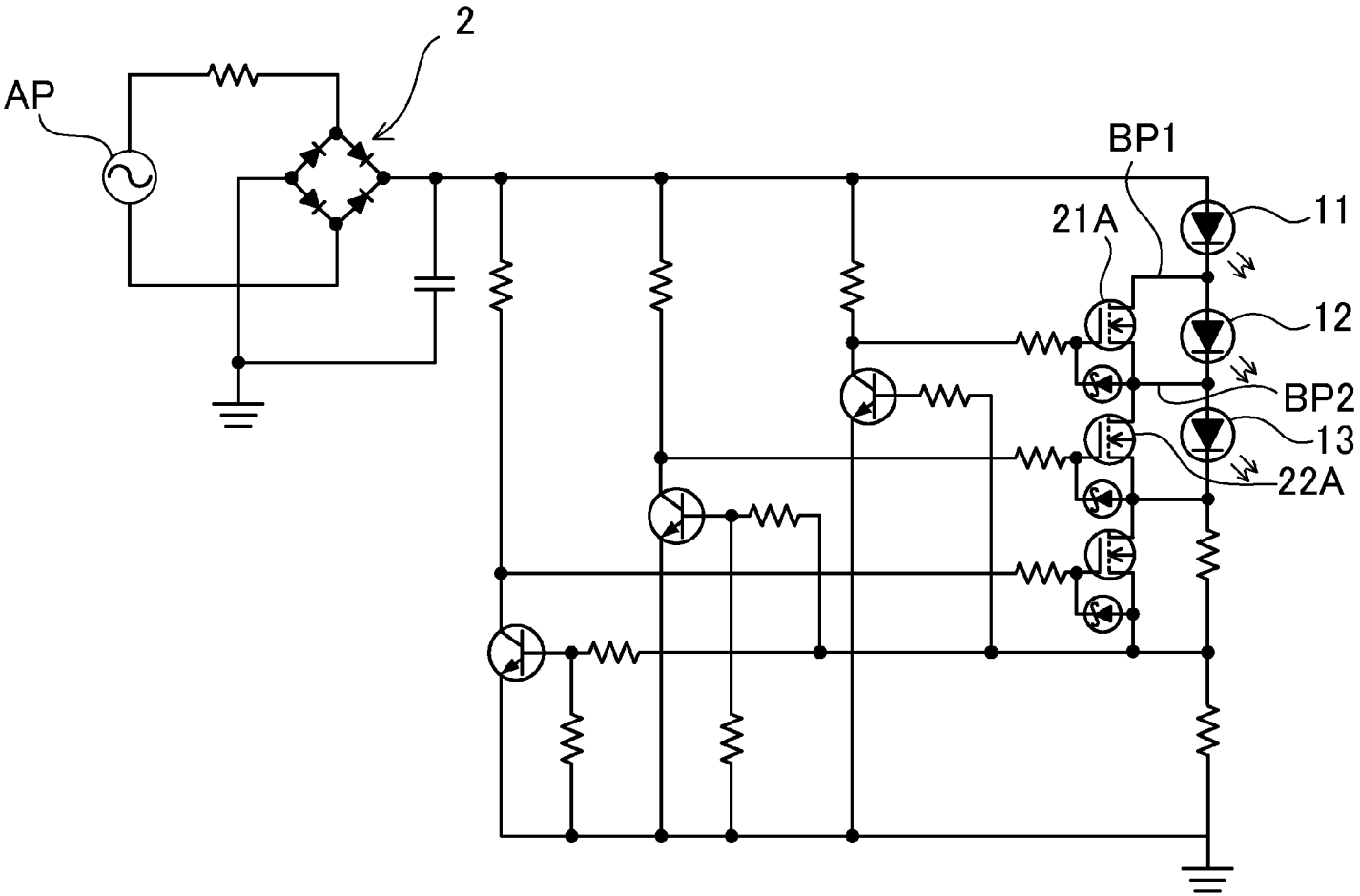
FIG. 18 is a circuit diagram showing an AC multi-stage circuit which has been developed by the applicant.
Figure 19:
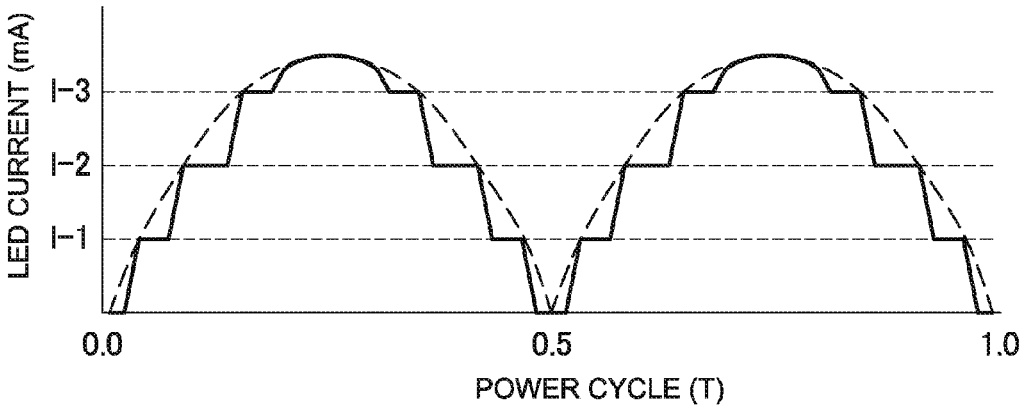
FIG. 19 is a graph showing a current waveform in the AC multi-stage circuit shown in FIG. 18.

FIGS. 3 and 4 are graphs for comparison between the current waveforms of the circuit according to the first embodiment and a circuit according to a comparative example 1 shown in FIG. 18. FIG. 3 is the graph showing the current waveform of the comparative example 1 superimposed over a power supply voltage. FIG. 4 is the graph showing the current waveform which is measured in the exemplary circuit according to the first embodiment.

Figure 5:
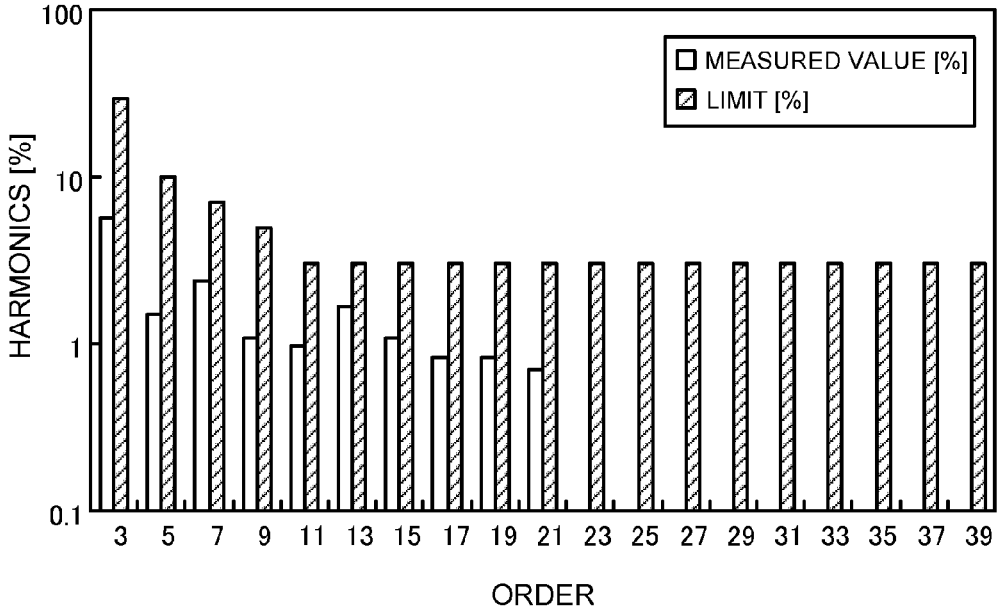
FIG. 5 is a graph showing harmonic components of the light-emitting diode driving apparatus shown in FIG. 2.
Figure 20:
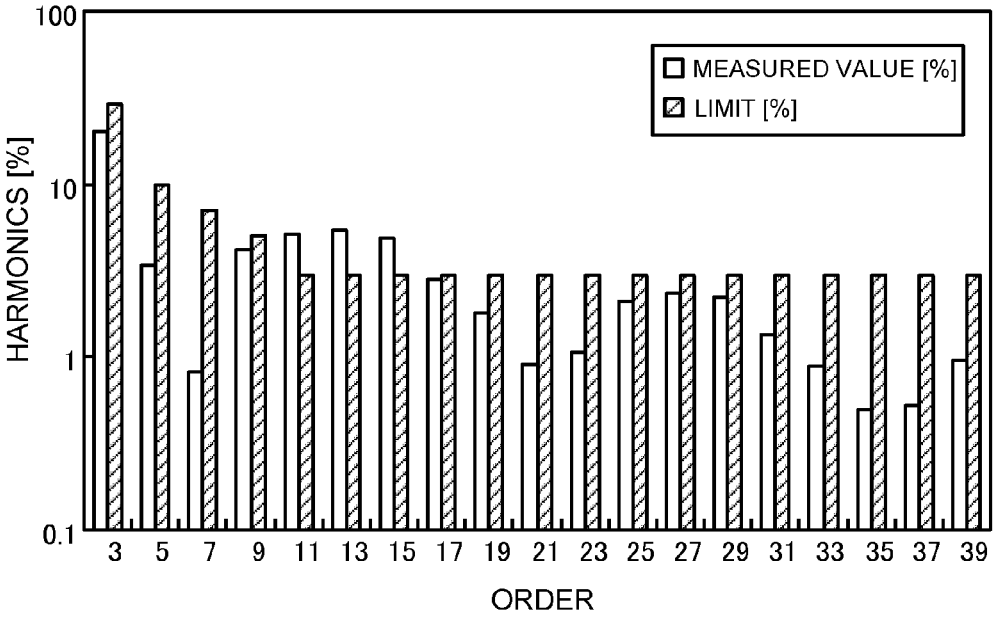
FIG. 20 is a graph showing harmonic components in the current waveform in the AC multi-stage circuit shown in FIG. 18.

FIG. 5 is a graph showing harmonic components. According to this comparison, it can be seen that harmonic components in the current waveform of the first embodiment decrease except 7th order, and that harmonic components of 11th, 13th and 15th orders are suppressed to values under the limits. In the exemplary circuit of FIG. 18, measured values of harmonic components of 11th, 13th and 15th orders exceed the limits as seen in FIG. 20.

Each LED section can be composed of a plurality of light-emitting diode devices connected to each other in series. Accordingly, a pulsating voltage can be effectively divided by the light-emitting diode devices. In addition, the light-emitting diode devices can smooth out a certain deviation of forward directional voltages Vf and the temperature characteristics of light-emitting diode devices. The number of LED sections, the number of light-emitting diode devices composing each LED section and the like can be suitably adjusted depending on required brightness, supplied voltage and the like. For example, an LED section can consist of one light-emitting diode device. The number of LED sections can be increased so that the LED section switching transition is smoother. Conversely, the number of LED sections can be two for simple control.

Figure 1B:
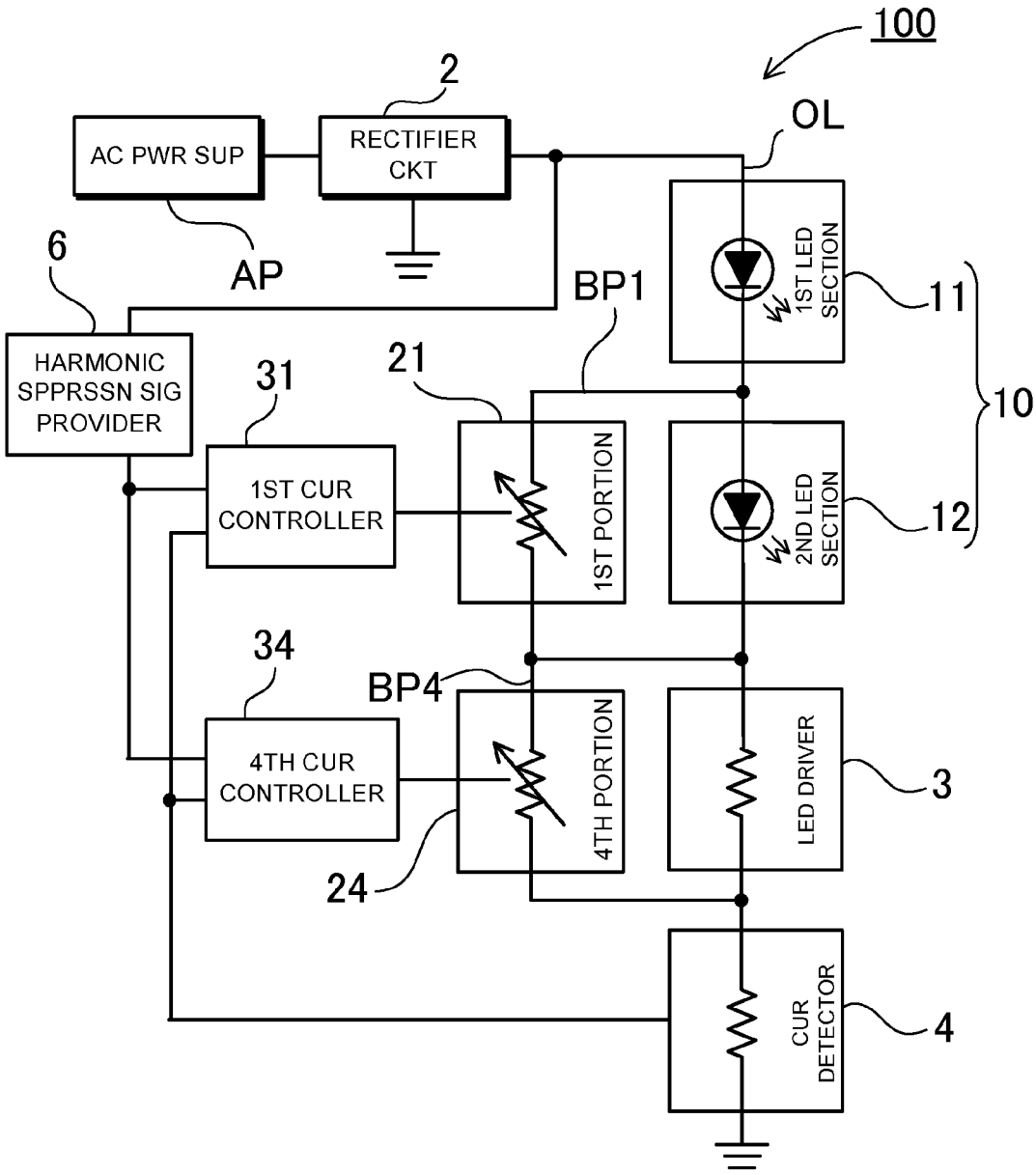
FIG. 1B is a block diagram showing a light-emitting diode driving apparatus according to a modified embodiment.
Figure 1C:
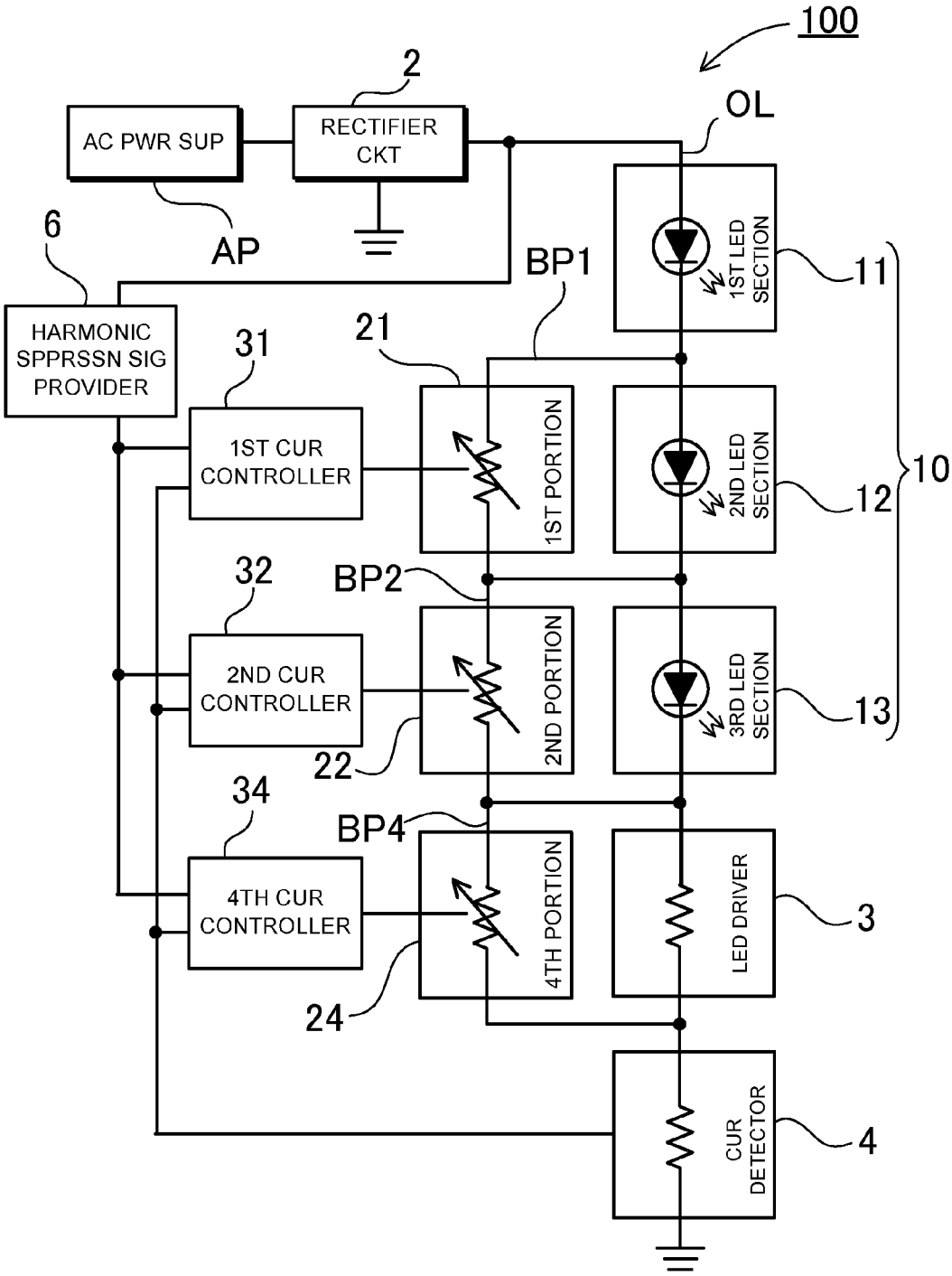
FIG. 1C is a block diagram showing a light-emitting diode driving apparatus according to another modified embodiment.

Although it has been described that the number of LED sections is four in the aforementioned configuration, needless to say, the number of LED sections can also be two or three, or five or more. FIG. 1B shows a light-emitting diode driving apparatus having two LED sections according to a modified embodiment. FIG. 1C shows a light-emitting diode driving apparatus having three LED sections according to another modified embodiment. In particular, in the case where the number of LED sections is increased, the current waveform can be controlled so as to have a smoother stepped shape. Accordingly, it is possible to further suppress harmonic components. Although the LED sections are turned ON/OFF one by one every when the input current reaches predetermined values the differences of which are substantially constant in the case of FIG. 1A, the differences of the predetermined values are not limited to constant. The LED sections may be turned ON/OFF one by one every when the input current reaches predetermined values the differences of which are not constant.

Although the LEDs are distributed in the four LED sections each of which has the same Vf value in the foregoing embodiment, the LED sections are not required to have the same Vf value. For example, if the Vf value of the first LED section is reduced as lower as possible, in other words, if the Vf value of the first LED section is set about 3.6 V, which corresponds to the Vf value of a single LED, the leading edge of the current can be closer to the rise timing of the sine wave from zero while the trailing edge of the current can be closer to the decay timing of the sine wave to zero in the waveform shown in FIG. 4. In this case, it is more advantageous to reduce harmonic components. In the case where the number and the Vf values of the LED sections are suitably selected, the current waveform can more closely approximate the sine wave. Such flexibility can more easily provide harmonic suppression.

The minimum voltage difference between the negative-side input terminals of adjacent operational amplifiers can be set to any value not lower than the offset voltage of the operational amplifier, for example, can be set to about several millivolts. This is advantageous for circuit designing. For example, if the current control portions are composed of transistors as in the case of an AC multi-stage circuit shown in FIG. 18, the minimum voltage difference is necessarily set not smaller than several tens mV from viewpoint of setting current variation due to temperature difference between positions on a circuit board on which the semiconductor parts are mounted. Contrary to this, the minimum voltage difference in the exemplary circuit according to the first embodiment can be set a value about a tenth of the voltage difference of the construction where the current control portions are composed of transistors. In the construction according to the first embodiment, LED section currents can be minutely set. In addition, the number of LED sections or the like can be flexibly increased. As a result, the waveform can more closely approximate the sine wave. From this reason, the construction according to the first embodiment has such an advantage even if the trade-off for improvement in approximation is some increase in parts cost or the like.

Second Embodiment

Figure 6:
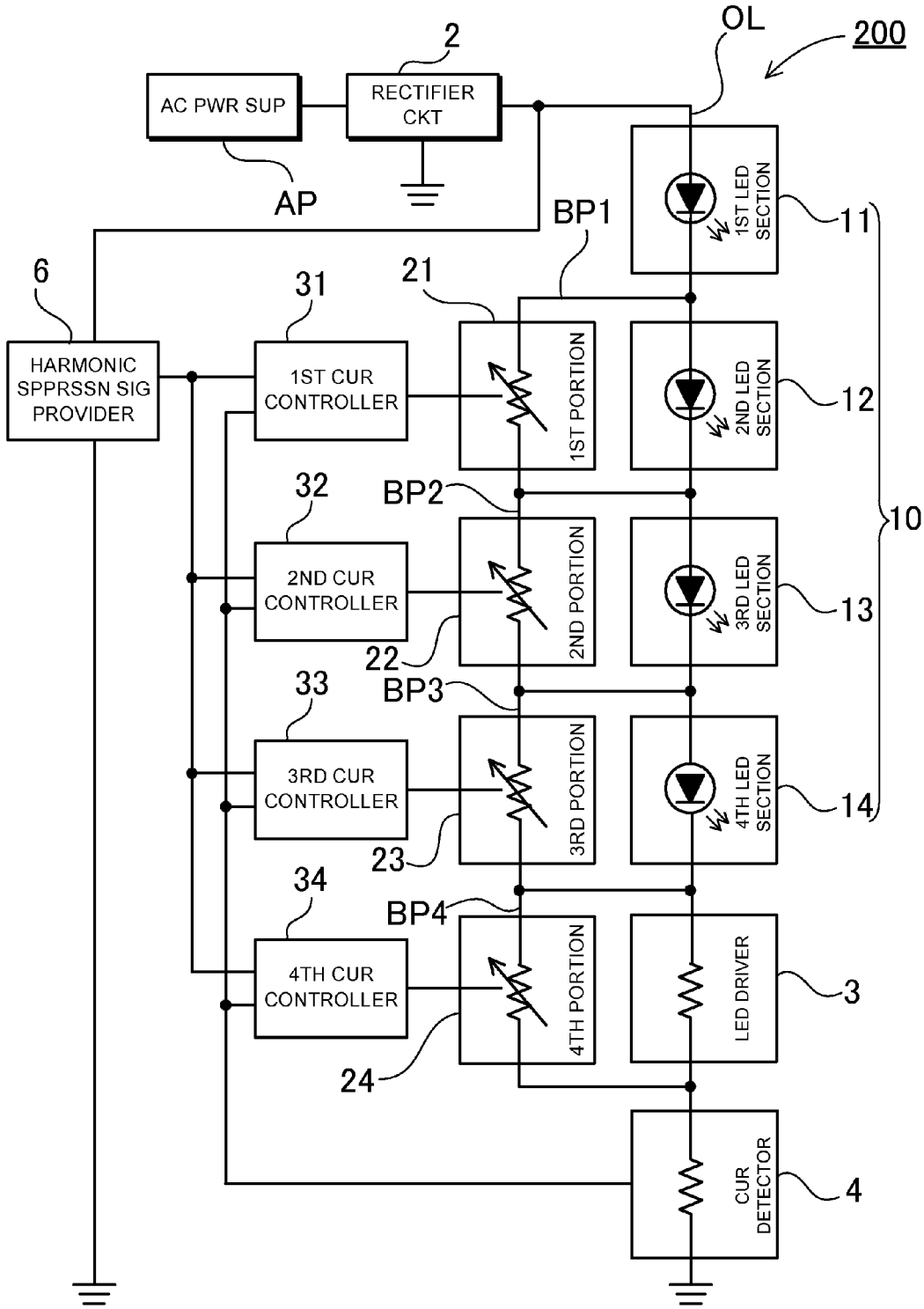
FIG. 6 is a block diagram showing a light-emitting diode driving apparatus according to a second embodiment.
Figure 7:
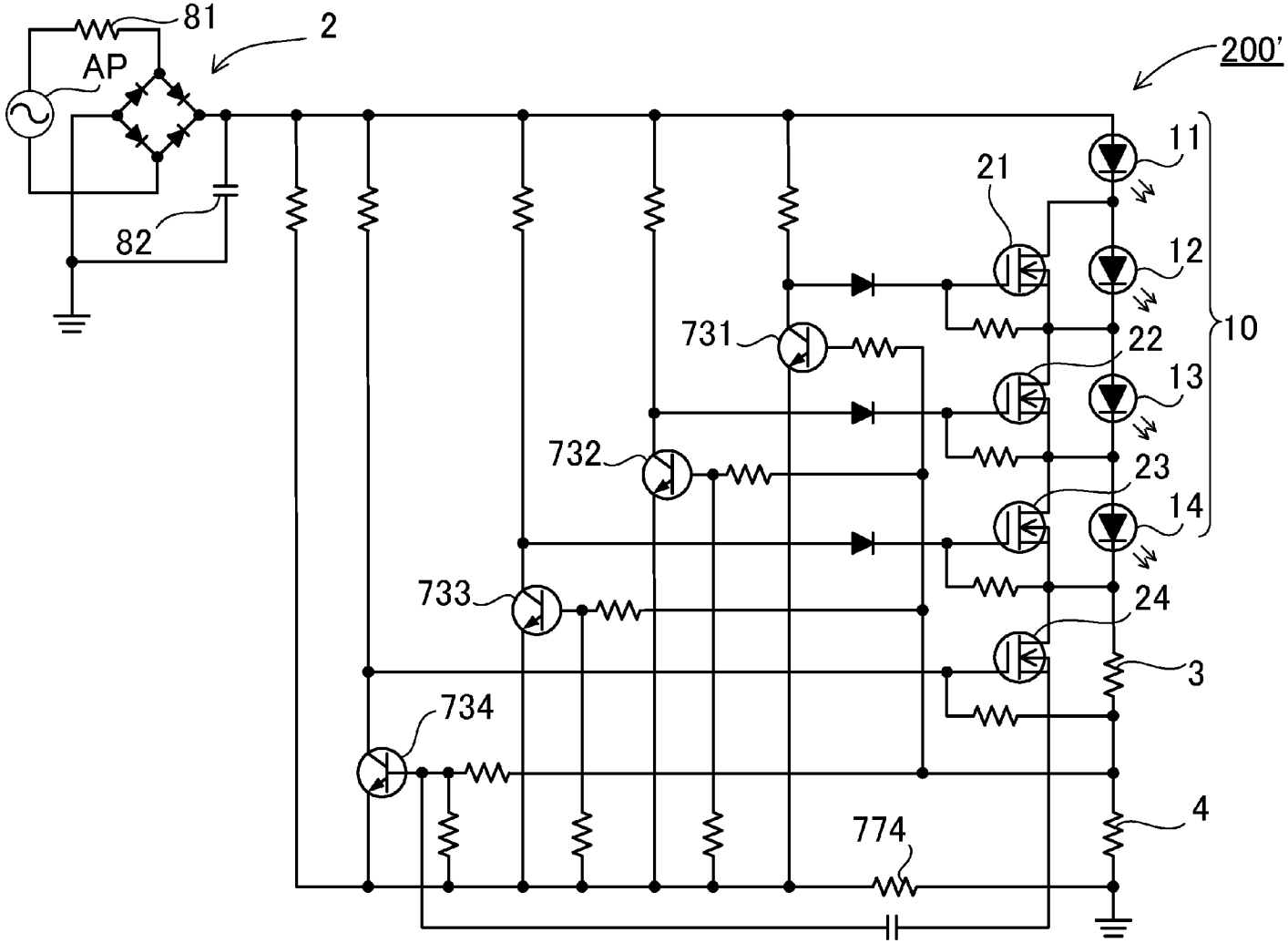
FIG. 7 is a circuit diagram showing an exemplary circuit of the light-emitting diode driving apparatus shown in FIG. 6.

FIG. 6 is a block diagram showing a light-emitting diode driving apparatus 200 according to a second embodiment in which transistors are used as current control portions instead of operational amplifiers. FIG. 7 specifically shows an exemplary circuit of a light-emitting diode driving apparatus 200'. In FIG. 7, members that are configured similarly to the members of the light-emitting diode driving apparatus 100 according to the foregoing first embodiment shown in FIG. 2 (the LED sections, the first to fourth portions, etc.) are attached with the same reference numerals as the corresponding members of the light-emitting diode driving apparatus 100, and their description is omitted for sake of brevity.

The harmonic suppression signal providing portion 6 shown in the block diagram of FIG. 6 is composed of resistors 6 in the case of the circuit diagram of FIG. 7. A pulsating current is applied to the collector terminals of transistors 731, 732, 733 and 734, which in turn can provide an LED driving current waveform as shown in FIG. 4. In the second embodiment, a resistor 774 is provided for impedance matching. According to the second embodiment, it is possible to provide similar effects to the first embodiment.

Third Embodiment

Figure 8:
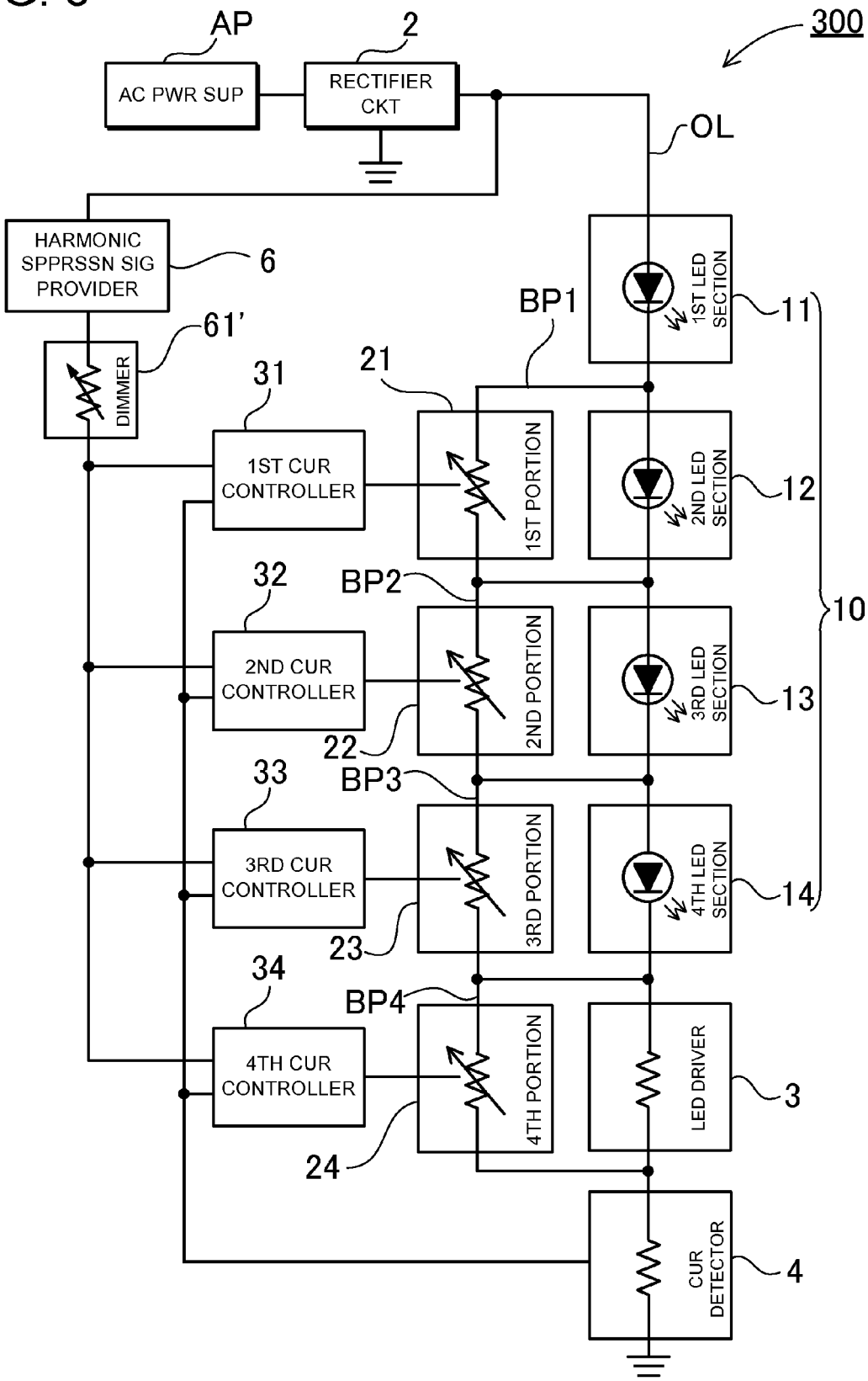
FIG. 8 is a block diagram showing a light-emitting diode driving apparatus according to a third embodiment.
Figure 9:
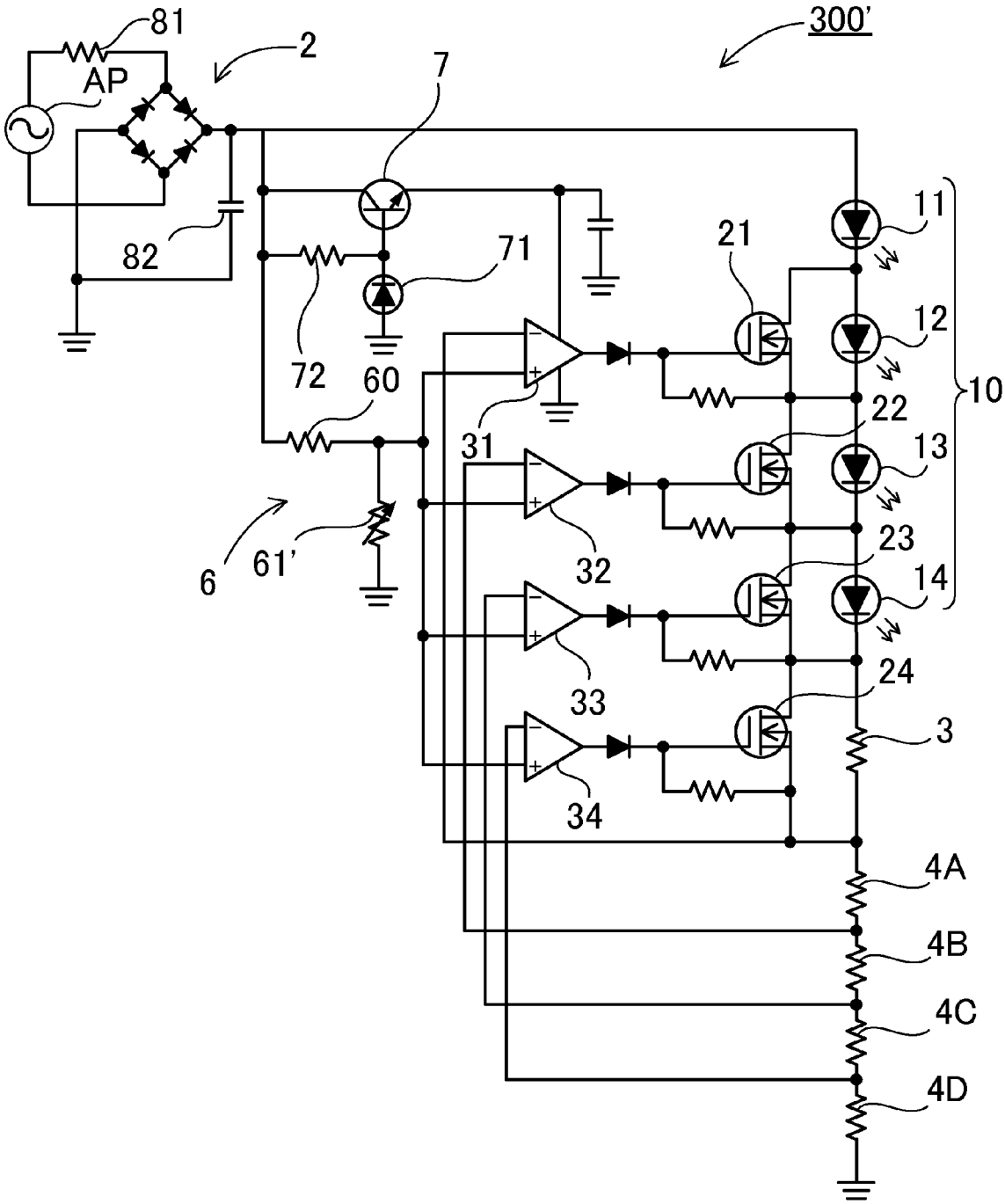
FIG. 9 is a circuit diagram showing an exemplary circuit of the light-emitting diode driving apparatus shown in FIG. 8.

FIG. 8 is a block diagram showing a light-emitting diode driving apparatus 300 according to a third embodiment in which a dimmer is additionally provided to the exemplary circuit of the first embodiment. FIG. 9 specifically shows an exemplary circuit of a light-emitting diode driving apparatus 300'. In these figures, members that are configured similarly to the members of the light-emitting diode driving apparatus 100 according to the foregoing first embodiment shown in FIG. 2, or the like are attached with the same reference numerals as the corresponding members of the light-emitting diode driving apparatus 100, and their description is omitted for sake of brevity.

As shown in the exemplary circuit in FIG. 9, a variable resistor 61' is provided in FIG. 9 instead of the resistor 61 in the circuit diagram according to the first embodiment shown in FIG. 2. In the case where the resistance of the variable resistor 61' is set the maximum, the maximum voltage in the variable range is applied to the positive-side input terminals of the operational amplifiers 31 to 34, while the maximum voltage will be applied to the negative terminals through the current detection resistors 4A to 4D when the operational amplifiers 31 to 34 operate. As a result, the light intensity of the light-emitting diode driving apparatus can be set to the maximum available light intensity. On the other hand, in the case where the resistance of the variable resistor is set to the minimum, in other words, the positive-side input terminals of the operational amplifiers are connected to GND (grounded), the light-emitting diode driving apparatus will be brought OFF. Thus, the variable resistor 61' serves as a dimmer.

According to this dimmer, the light intensity of the light-emitting diode driving apparatus can be reduced by a reduced current having a similar shape to the current waveform in the case of the maximum available light intensity. In conventional, typical filament lamps, a current from AC power supply is turned ON/OFF in accordance with time by thyristor, triac or the like. For this reason, the reduced current in conventional, typical filament lamps has not a similar shape to the current waveform in the case of the maximum available light intensity. Accordingly, the light intensity of the light-emitting diode driving apparatus according to this embodiment can be adjusted without increasing distortion factor and without increasing harmonic components as compared with conventional, typical filament lamps. Also, advantageously, the power factor is not reduced.

Fourth Embodiment

Figure 10:
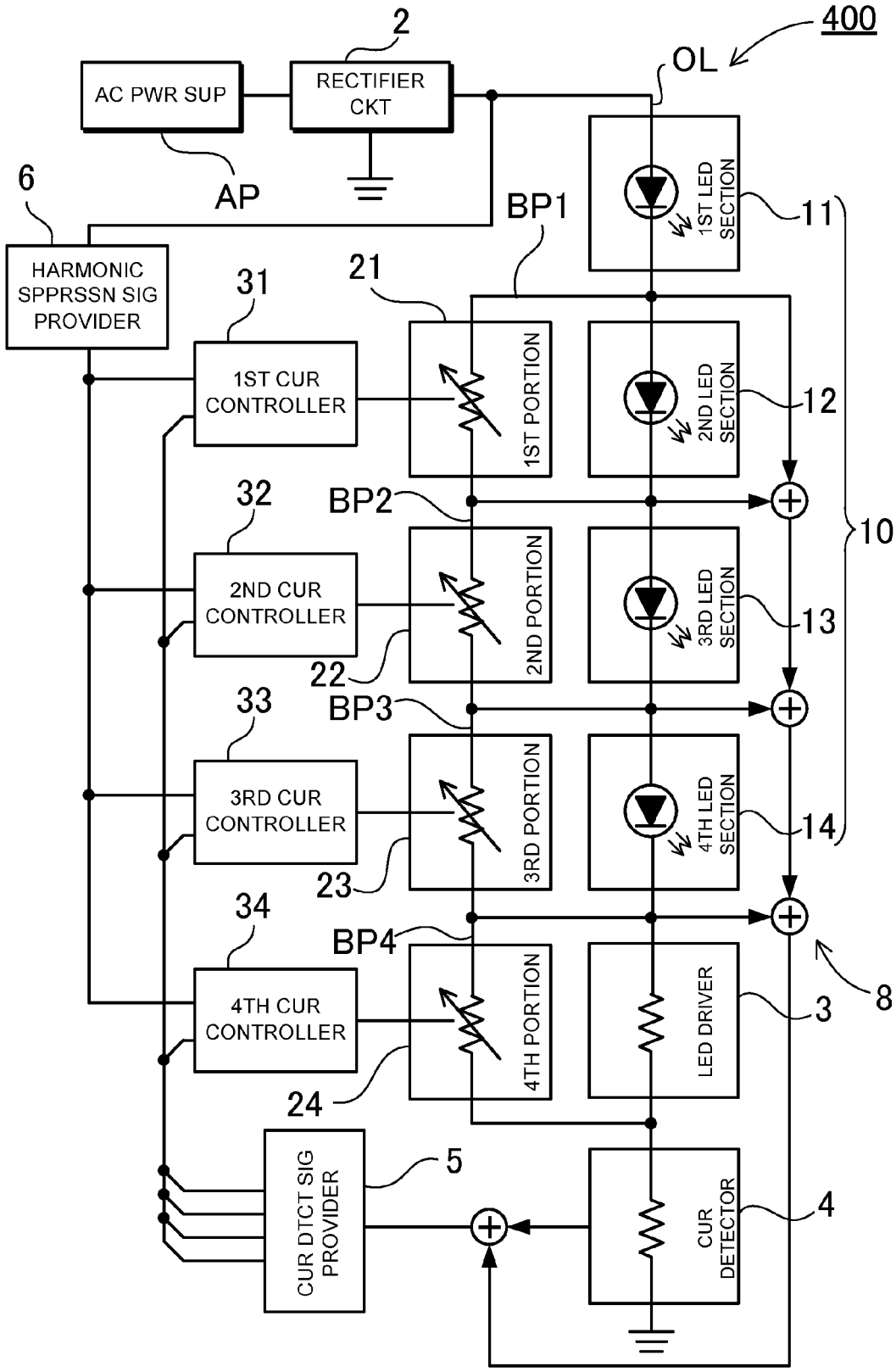
FIG. 10 is a block diagram showing a light-emitting diode driving apparatus according to a fourth embodiment.
Figure 11:
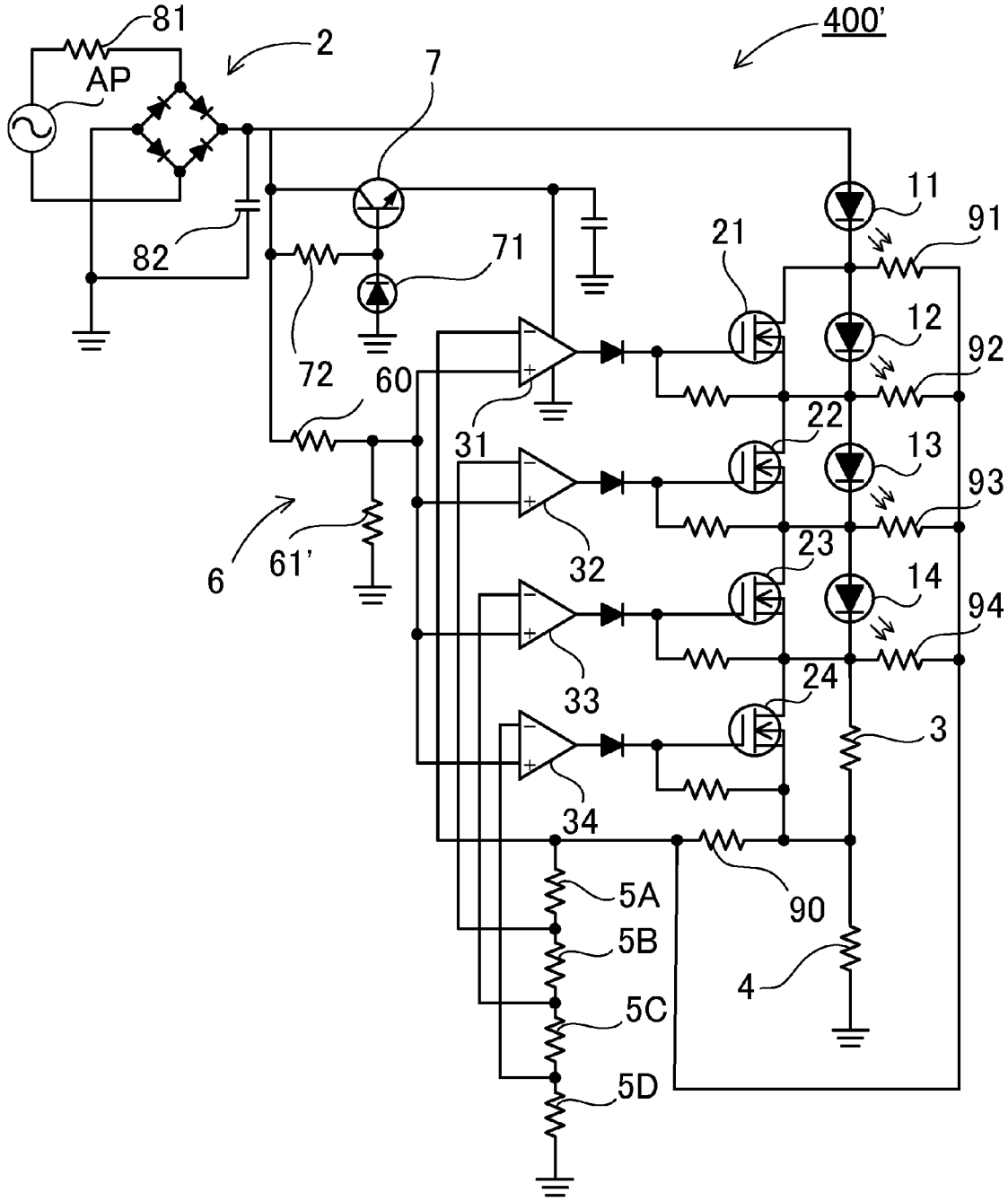
FIG. 11 is a circuit diagram showing an exemplary circuit of the light-emitting diode driving apparatus shown in FIG. 10.

In the aforementioned exemplary circuit shown on FIG. 2 or the like, the current detection resistors serve as a current detection signal providing portion which provides a current detection signal to the current control portions. On the other hand, a current detection signal providing portion 5 can be provided separately from the current detection resistors. The current detection signal providing portion 5 distributes current detection signals which are detected by the current detection portion 4, and are provided to the current control portions. FIG. 10 is a block diagram of showing this type of a light-emitting diode driving apparatus 400 according to a fourth embodiment. FIG. 11 is a circuit diagram showing a light-emitting diode driving apparatus 400' according to the fourth embodiment. In these figures, members that are configured similarly to the members of in the foregoing first embodiment or the like are attached with the same reference numerals, and their description is omitted for sake of brevity.

(Current Detection Signal Providing Portion 5)

The current detection signal providing portion 5 distributes the current detection signal detected by the current detection portion 4, and provides the distributed signals to the first, second, third and fourth current control portions 31, 32, 33 and 34. In the case of FIG. 11, the current detection signal providing portion 5 corresponds to current detection signal providing resistors 5A to 5D. Also, electric power variation suppression resistors 90 and 91 to 94 compose a voltage variation suppression signal providing portion 8.

(Voltage Variation Suppression Signal Providing Portion 8)

In the light-emitting diode driving apparatus, the voltage variation suppression signal providing portion 8 can be provided. The voltage variation suppression signal providing portion 8 mixes the outputs of the first, second, third and fourth LED sections 11, 12, 13 and 14. In this case, the cathode terminals of the first, second, third and fourth LED sections 11, 12, 13 and 14 are connected to each other through the electric power variation suppression resistors. Thus, the voltage variation suppression signal providing portion 8 produces the voltage variation suppression signal, and provide the voltage variation suppression signal to the current detection signal providing portion 5. Accordingly the harmonic suppression signal providing portion 6 can more accurately control harmonic suppression based on the mixed signal which is obtained by adding the voltage variation suppression signal provided from the voltage variation suppression signal providing portion 8 to the current detection signal provided from the current detection signal providing portion 5. According to this construction, it is possible to provide an LED driving circuit which can drive LEDs with the power supply voltage variation being less likely to affect the LED light intensity.

Fifth Embodiment

Figure 12:
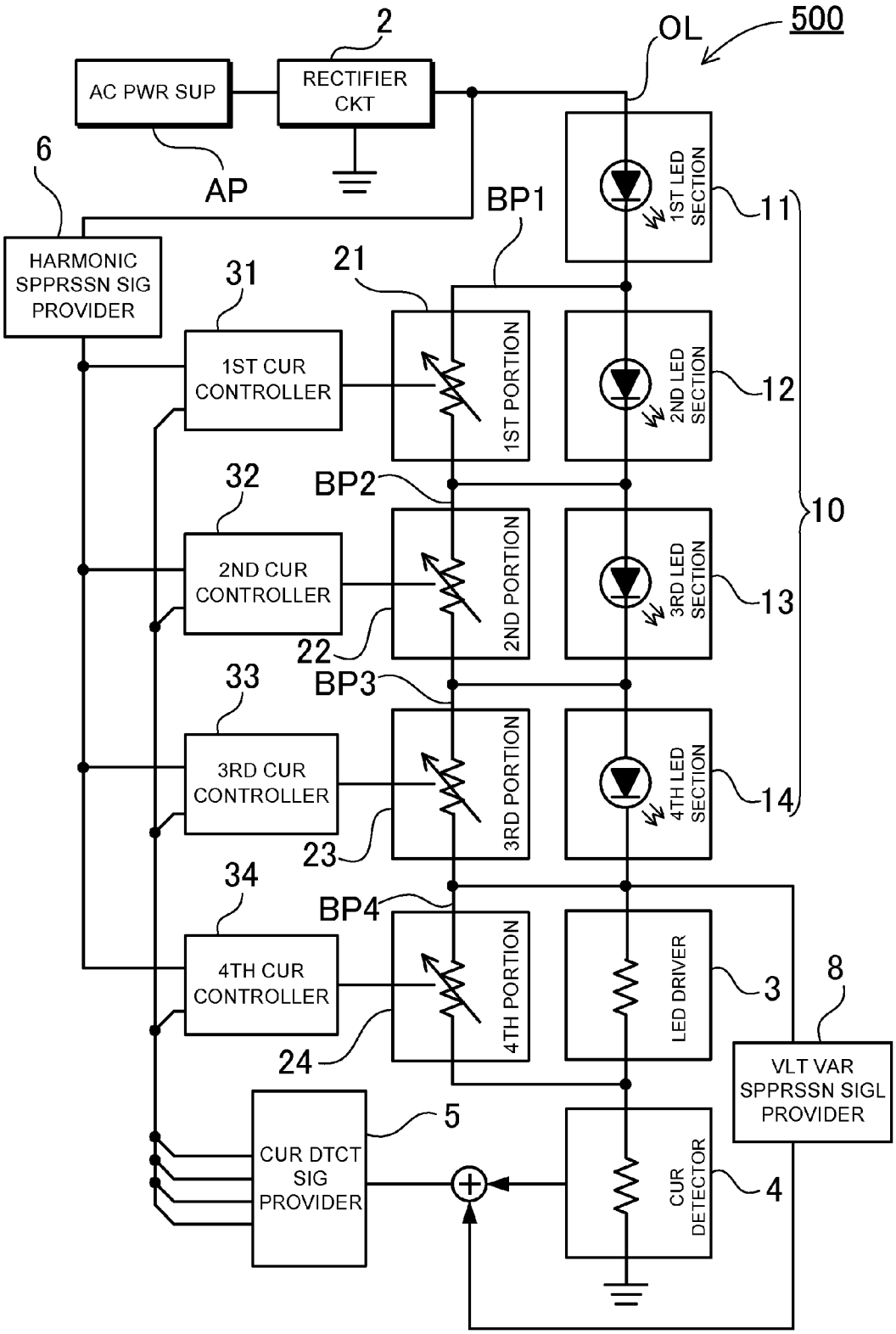
FIG. 12 is a block diagram showing a light-emitting diode driving apparatus according to a fifth embodiment.
Figure 13:
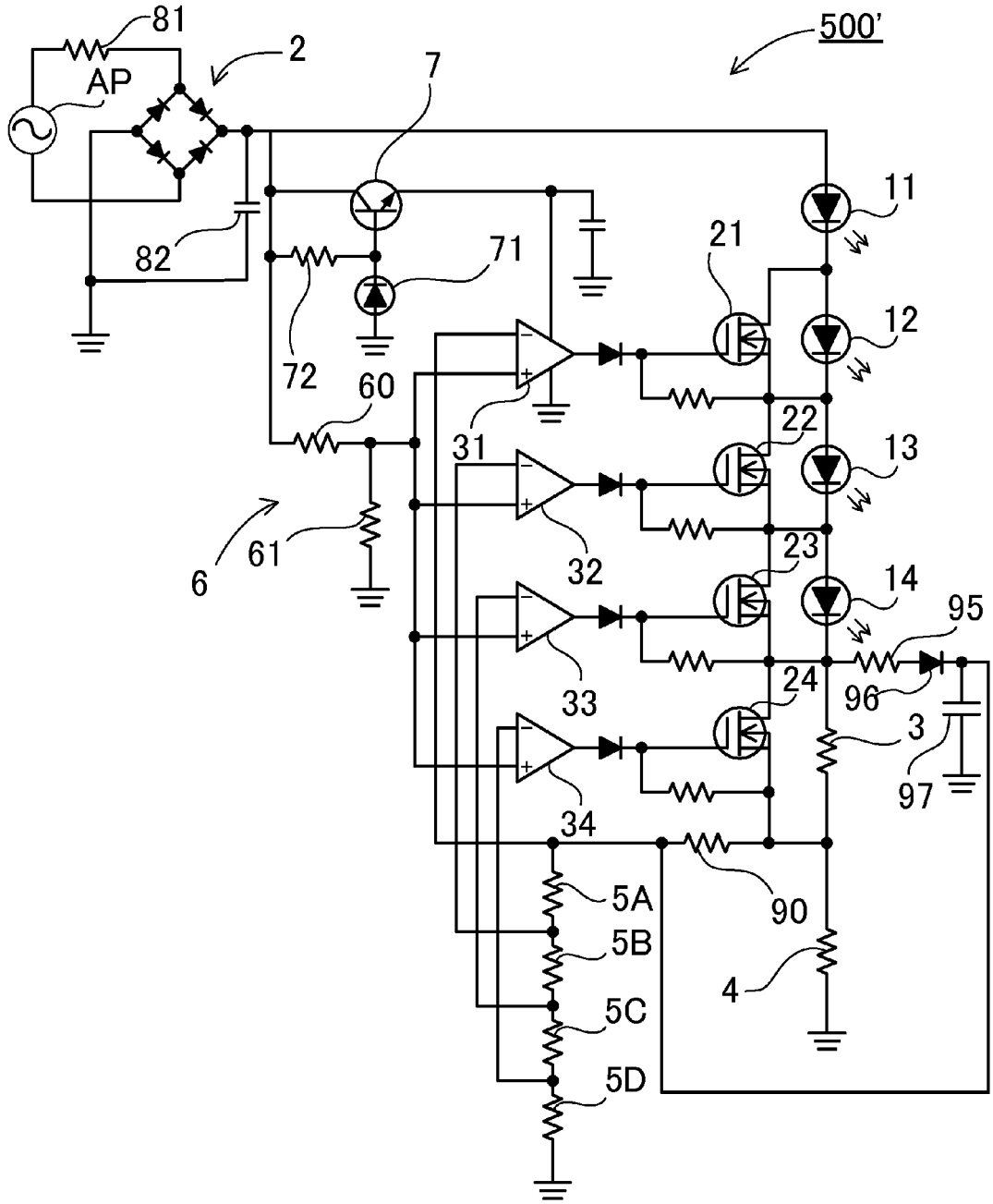
FIG. 13 is a circuit diagram showing an exemplary circuit of the light-emitting diode driving apparatus shown in FIG. 12.

Although the voltage variation suppression signal providing portion 8 is connected to the LED sections so that outputs are individually detected in the embodiment shown in FIGS. 10 and 11, the present invention is not limited to this. The output of the entire LED portion 10 may be detected. FIG. 12 is a block diagram of showing this type of a light-emitting diode driving apparatus 500 according to a modified embodiment as fifth embodiment. FIG. 13 is a circuit diagram showing a light-emitting diode driving apparatus 500' according to the fifth embodiment. In the foregoing fourth embodiment, the voltage variation suppression signal is added to the current detection signal only by the resistors as shown in the circuit diagram of FIG. 11. On the other hand, according to the fifth embodiment, the voltage variation suppression signal is integrated before the addition, and the integrated signal is added to the current detection signal as shown in the circuit diagram of FIG. 13. To achieve this, in addition to an electric power variation suppression resistor 95, a diode 96 and a capacitor 97 are provided in the exemplary circuit shown in FIG. 13.

Figure 14:
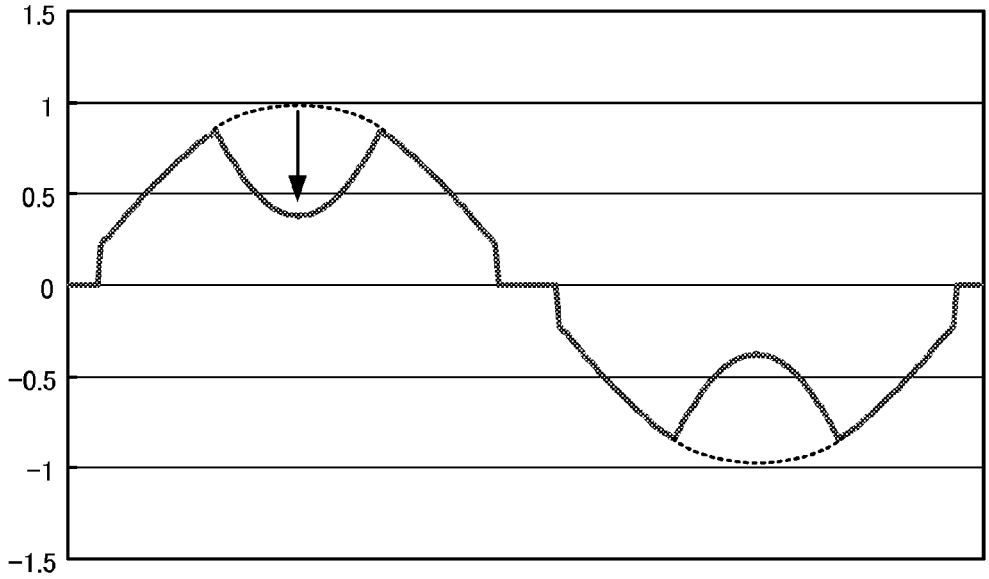
FIG. 14 is a graph showing a current waveform in the fourth embodiment.
Figure 15:
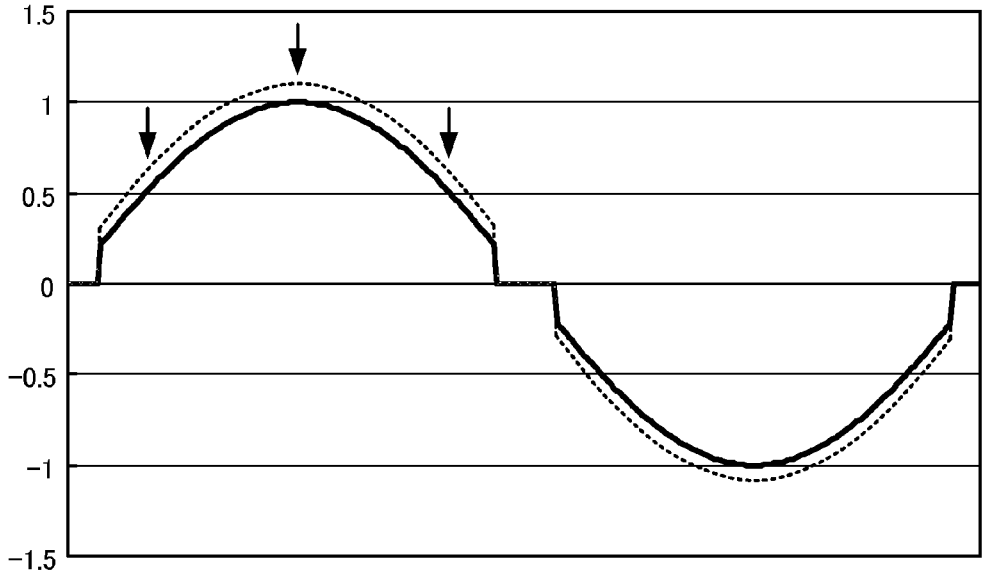
FIG. 15 is a graph showing a current waveform in the fifth embodiment.
Figure 16:
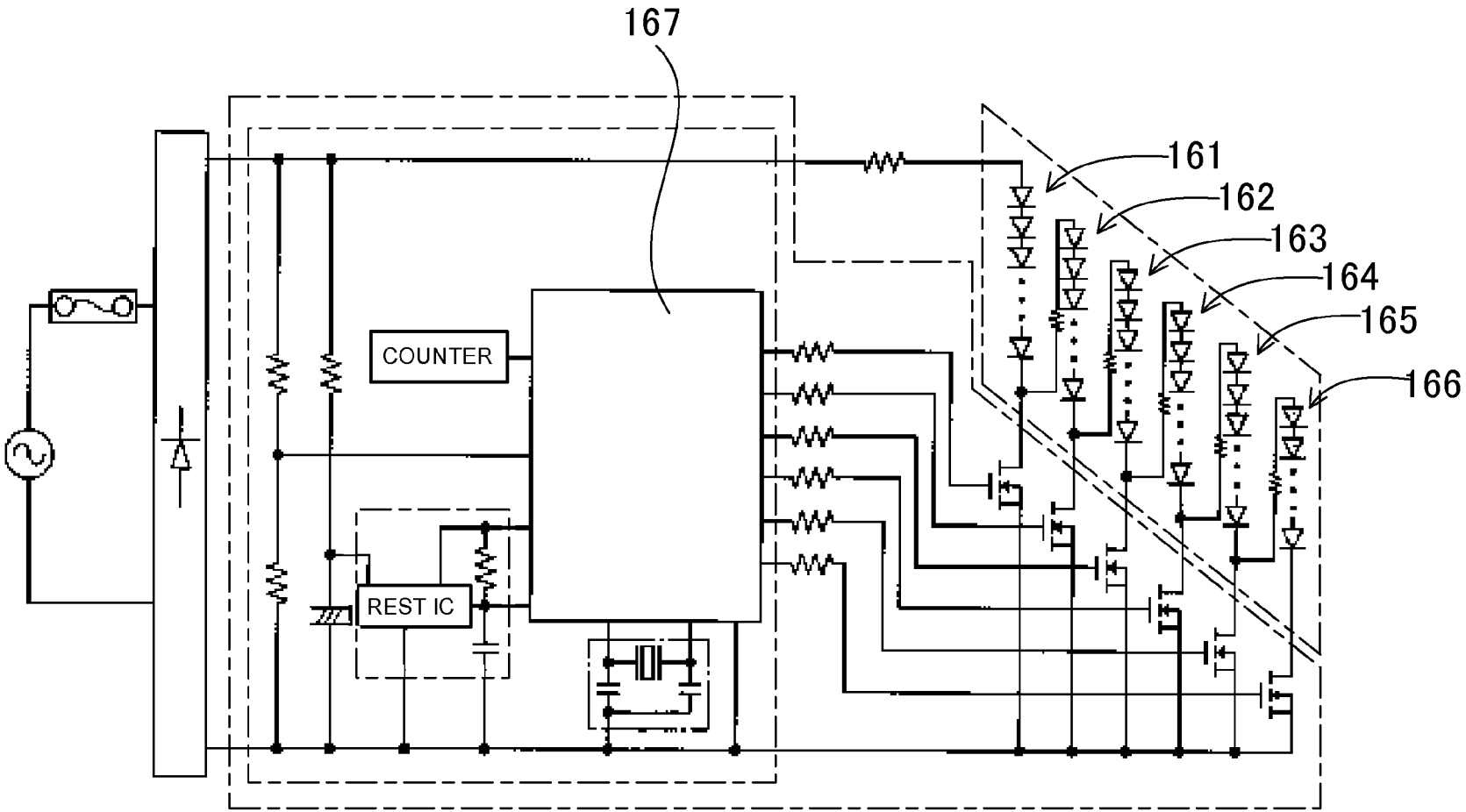
FIG. 16 is a circuit diagram showing a conventional LED driving circuit which uses a microcomputer.
Figure 17:
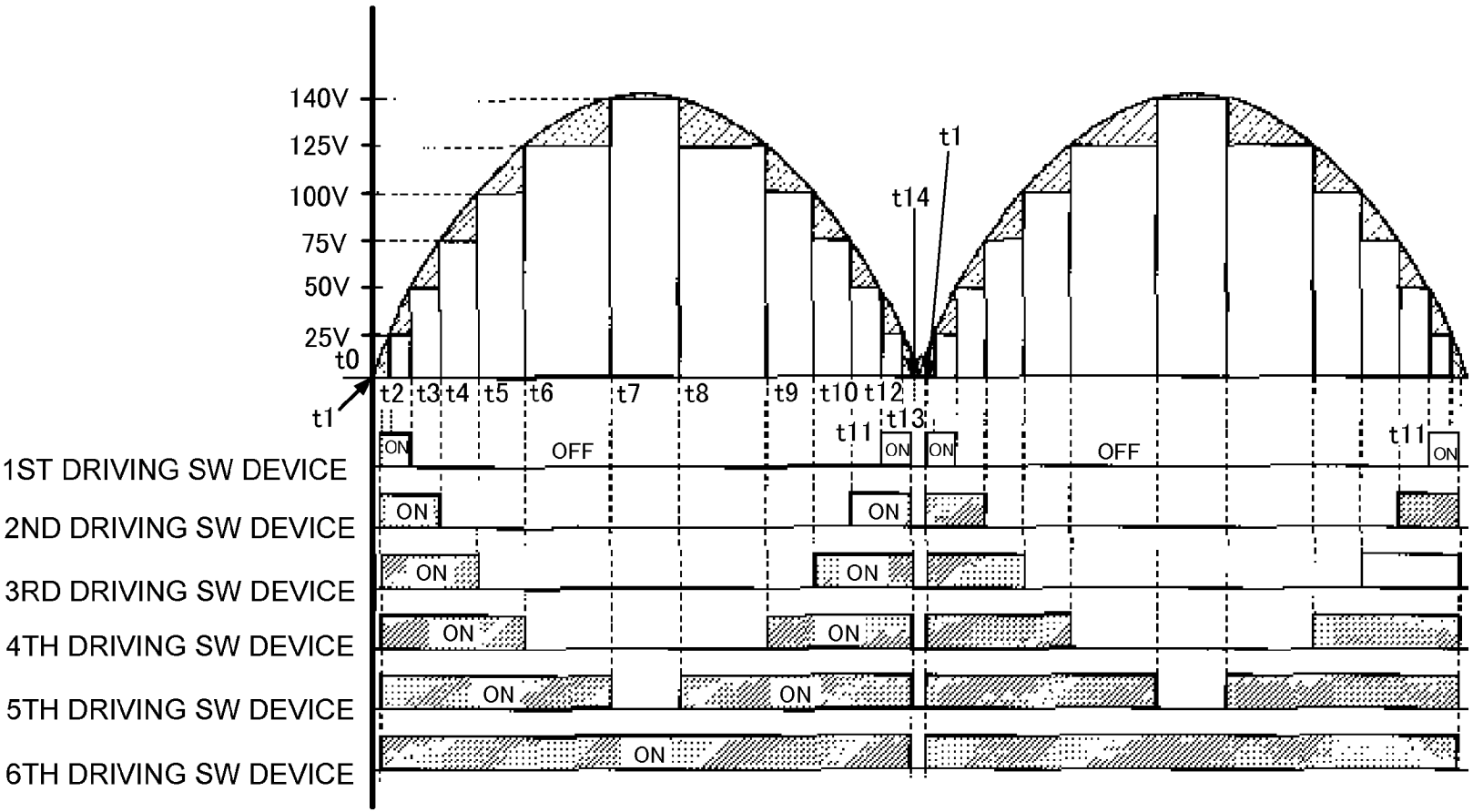
FIG. 17 is a timing chart showing operation of the LED driving circuit shown in FIG. 16.

FIGS. 14 and 15 show the current waveforms obtained by the exemplary circuits according to the fourth and fifth embodiments, respectively. In the exemplary circuit according to the fourth embodiment, the voltage variation suppression signal provided by the voltage variation suppression signal providing portion 8 is added to the current detection signal detected by the current detection portion 4. Thus, the current variation in accordance with voltage variation can be suppressed. That is, in the first to third embodiments, since a current is controlled in proportion to the power supply voltage detected by the harmonic suppression signal providing portion 6, the current will be increased as the power supply voltage is increased while the current will be reduced as the power supply voltage is reduced. According to the fourth and fifth embodiments, the current variation is suppressed by the voltage variation suppression signal provided by the voltage variation suppression signal providing portion 8 so that the maximum current is controlled closer to the average current. The operation in the fourth embodiment is now described with reference to FIG. 14. As shown in FIG. 14, the current waveform without the voltage variation suppression shown by the dotted line is controlled to the current waveform with the voltage variation suppression shown by the solid line. In the case of the current waveform in FIG. 14, the first to third electric power variation suppression resistors 91 to 93 are not provided, and only the fourth electric power variation suppression resistor 94 is provided in FIG. 11.

In this case, as the arrow shows to FIG. 14, the current is reduced only in the range near the maximum pulsating voltage. Accordingly, since the fourth LED section 14 is turned ON only in this period, the brightness of the fourth LED section 14 is smaller as compared with the first to third LED sections 11 to 13.

On the other hand, in the exemplary circuit according to the fifth embodiment, the integrated suppression signal is added so that the waveform entirely reduced as shown in FIG. 15. In this embodiment, it is possible to avoid that the brightness of the fourth LED section 14 is very small as compared with the other LED sections. Since the current can have a sine waveform, this embodiment has an advantage from the viewpoint of harmonic current suppression.

INDUSTRIAL APPLICABILITY

The aforementioned light-emitting diode driving apparatus includes LED devices. The LED devices and the driving circuit for driving the LED devices can be mounted on a common circuit board. This light-emitting diode driving apparatus can be used as a lighting apparatus driven by AC commercial power for home use.

It should be apparent to those with an ordinary skill in the art that while various preferred embodiments of the invention have been shown and described, it is contemplated that the invention is not limited to the particular embodiments disclosed, which are deemed to be merely illustrative of the inventive concepts and should not be interpreted as limiting the scope of the invention, and which are suitable for all modifications and changes falling within the scope of the invention as defined in the appended claims. The present application is based on Application No. 2011-90,516 filed in Japan on Apr. 14, 2011, the content of which is incorporated herein by reference.

What is claimed is:

1. A light-emitting diode driving apparatus comprising:

a rectifying circuit that can be connected to AC power supply and rectifies an AC voltage of the AC power supply to provide a rectified voltage;

a first LED section that includes at least one LED device connected to said rectifying circuit;

a second LED section that includes at least one LED device serially connected to said first LED section;

a first portion that is connected in parallel to said second LED section, and controls the flowing current amount in said first LED section;

a fourth portion that is serially connected to said first portion, and controls the flowing current amount in said first and second LED sections;

a first current control portion that controls said first portion;

a fourth current control portion that controls said fourth portion;

a current detection portion that detects a current detection signal based on the amount of a current flowing in an output line serially connected from said first LED section to said second LED section; and a harmonic suppression signal providing portion that provides a harmonic suppression signal voltage based on the rectified voltage provided from said rectifying circuit, wherein said first and fourth current control portions compare the current detection signal detected by said current detection portion with the harmonic suppression signal voltage provided by said harmonic suppression signal providing portion, and control said first and fourth portions based on the comparison result whereby suppressing harmonic components.

2. The light-emitting diode driving apparatus according to claim 1 further comprising a third LED section that includes at least one LED device serially connected to said second LED section, a second portion that is connected in parallel to said third LED section, and controls the flowing current amount in said first and second LED sections, and a second current control portion that controls said second portion, wherein said second current control portion compares the current detection signal detected by said current detection portion with the harmonic suppression signal voltage provided by said harmonic suppression signal providing portion, and controls said second portion based on the comparison result whereby suppressing harmonic components, and wherein said fourth portion controls the flowing current amount in the first, second and third LED sections.

3. The light-emitting diode driving apparatus according to claim 2 further comprising a fourth LED section that includes at least one LED device serially connected to said third LED section, a third portion that is connected to said fourth LED section in parallel, and controls the flowing current amount in said first, second and third LED sections, and a third current control portion that controls said third portion, wherein said fourth portion controls the flowing current amount in the first, second, third and fourth LED sections.

4. The light-emitting diode driving apparatus according to claim 1 further comprising an LED driving portion that is connected in parallel to said fourth portion.

5. The light-emitting diode driving apparatus according to claim 3 further comprising a current detection signal providing portion that distributes the current detection signal detected by said current detection portion, and provides the distributed signals as the current detection signal to the first, second, third and fourth current control portions.

6. The light-emitting diode driving apparatus according to claim 5 further comprising a voltage variation suppression signal providing portion that mixes and the outputs of said first, second, third and fourth LED sections to produce a voltage variation suppression signal, and provide the voltage variation suppression signal to said current detection signal providing portion.

7. The light-emitting diode driving apparatus according to claim 5, wherein after mixing and the outputs of said first, second, third and fourth LED sections to produce a voltage variation suppression signal, and adding the voltage variation suppression signal to the current detection signal as the current value, which is detected by said current detection portion, said current detection signal providing portion provides said first, second, third and fourth current control portions with the signal obtained by adding the voltage variation suppression signal to the current detection signal.

8. The light-emitting diode driving apparatus according to claim 5, wherein after mixing and the outputs of said first, second, third and fourth LED sections to produce a voltage variation suppression signal, and integrating the voltage variation suppression signal, said current detection signal providing portion provides the integrated signal to said first, second, third and fourth current control portions.

9. The light-emitting diode driving apparatus according to claim 1 further comprising a dimmer that is connected to the harmonic suppression signal providing portion, and adjusts the light intensity of the LED sections.

10. The light-emitting diode driving apparatus according to claim 1, wherein said harmonic suppression signal providing portion includes a plurality of current detection voltage dividing resistors which are serially connected to each other.

* * * * *